US009064469B2

(12) United States Patent
Hirakata et al.

(10) Patent No.: US 9,064,469 B2
(45) Date of Patent: Jun. 23, 2015

(54) METHOD FOR DRIVING LIQUID CRYSTAL DISPLAY DEVICE

(75) Inventors: Yoshiharu Hirakata, Ebina (JP); Shunpei Yamazaki, Setagaya (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 697 days.

(21) Appl. No.: 13/165,993

(22) Filed: Jun. 22, 2011

(65) Prior Publication Data

US 2012/0001953 A1 Jan. 5, 2012

(30) Foreign Application Priority Data

Jul. 2, 2010 (JP) ..... 2010-151814

(51) Int. Cl.

| | |
|---|---|
| ***G09G 3/36*** | (2006.01) |
| ***G09G 3/20*** | (2006.01) |
| ***G09G 3/34*** | (2006.01) |

(52) U.S. Cl.

CPC ..... *G09G 3/3648* (2013.01); *G09G 3/2025* (2013.01); *G09G 3/3406* (2013.01); *G09G 2310/0235* (2013.01); *G09G 2310/0237* (2013.01)

USPC ..... 345/690; 345/87; 345/88; 345/102

(58) Field of Classification Search

CPC ..... G09G 2310/0235; G09G 3/36–3/3696; G09G 2310/021

USPC ..... 345/87–104, 690–699, 204–214

See application file for complete search history.

(56) References Cited

U.S. PATENT DOCUMENTS 6,448,951 B1 * 9/2002 Sakaguchi et al. ..... 345/88
6,597,348 B1 7/2003 Yamazaki et al.

(Continued)

FOREIGN PATENT DOCUMENTS

JP 2000-275605 A 10/2000
JP 2006-220685 8/2006

(Continued)

OTHER PUBLICATIONS

Baron et al., "36.4: Can Motion Compensation Eliminate Color Breakup of Moving Objects in Field-Sequential Color Displays?" SID Digest '96: SID International Symposium Digest of Technical Papers, 1996, vol. 27, pp. 843-846.

(Continued)

*Primary Examiner* — Dmitriy Bolotin
(74) *Attorney, Agent, or Firm* — Eric J. Robinson; Robinson Intellectual Property Law Office, P.C.

(57) ABSTRACT

In a first subframe period, light sources of a first region and a third region emit lights at the same time; light sources of a second region and a fourth region emit no light at the same time, in which light emission of different colors is performed in the first region and the third region. In a second subframe period, light sources of the second region and the fourth region emit lights at the same time; light sources of the first region and the third region emit no light at the same time, in which light emission of different colors is performed in the second region and the fourth region. The first region and the third region are separated from each other with the second region interposed therebetween; and the second region and the fourth region are separated from each other with the third region interposed therebetween.

24 Claims, 24 Drawing Sheets

(56) References Cited

U.S. PATENT DOCUMENTS

| | | | | |
|---|---|---|---|---|
| 6,882,012 | B2 | 4/2005 | Yamazaki et al. | |
| 7,193,593 | B2 | 3/2007 | Koyama et al. | |
| 7,224,339 | B2 | 5/2007 | Koyama et al. | |
| 7,268,756 | B2 | 9/2007 | Koyama et al. | |
| 7,317,438 | B2 | 1/2008 | Yamazaki et al. | |
| 7,385,579 | B2 | 6/2008 | Satake | |
| 7,403,177 | B2 | 7/2008 | Tanada et al. | |
| 7,425,937 | B2 | 9/2008 | Inukai | |
| 7,773,066 | B2 | 8/2010 | Yamazaki et al. | |
| 7,791,571 | B2 | 9/2010 | Ohtani et al. | |
| 7,834,830 | B2 | 11/2010 | Yamazaki et al. | |
| 7,855,770 | B2 | 12/2010 | Egi et al. | |
| 2004/0080938 | A1* | 4/2004 | Holman et al. | 362/231 |
| 2006/0119566 | A1* | 6/2006 | Sato et al. | 345/102 |
| 2007/0025613 | A1* | 2/2007 | Lee et al. | 382/162 |
| 2007/0279374 | A1 | 12/2007 | Kimura et al. | |
| 2008/0074382 | A1* | 3/2008 | Lee et al. | 345/102 |
| 2008/0259099 | A1 | 10/2008 | Arai et al. | |
| 2009/0267878 | A1* | 10/2009 | Song et al. | 345/87 |
| 2009/0273555 | A1* | 11/2009 | Song et al. | 345/96 |
| 2009/0273557 | A1* | 11/2009 | Song et al. | 345/100 |
| 2010/0007637 | A1* | 1/2010 | Takatori | 345/204 |
| 2010/0066945 | A1* | 3/2010 | Kamada | 349/64 |
| 2010/0134451 | A1* | 6/2010 | Cho et al. | 345/205 |
| 2010/0171818 | A1* | 7/2010 | Takatori | 348/51 |
| 2010/0321376 | A1* | 12/2010 | Takatori | 345/214 |
| 2010/0321420 | A1 | 12/2010 | Ohtani et al. | |
| 2011/0001725 | A1 | 1/2011 | Kurokawa | |
| 2011/0025729 | A1 | 2/2011 | Yamazaki et al. | |
| 2011/0051034 | A1 | 3/2011 | Egi et al. | |
| 2013/0088534 | A1 | 4/2013 | Arai et al. | |

FOREIGN PATENT DOCUMENTS

| | | |
|---|---|---|
| JP | 2007-264211 | 10/2007 |
| JP | 2008-268322 A | 11/2008 |
| JP | 2009-042405 | 2/2009 |

OTHER PUBLICATIONS

Kurita et al., "Evaluation and Improvement of Picture Quality for Moving Images on Field-sequential Color Displays," IDW '00: Proceedings of the 17th International Display Workshops, 2000, pp. 69-72.

Taira et al., "A15 Field-Sequential Display without Color Break-Up using an AFLC Color Shutter," IDW '00: Proceedings of the 17th International Display Workshops, 2000, pp. 73-76.

Jarvenpaa, "7.2: Measuring Color Breakup of Stationary Images in Field-Sequential-Color Displays," SID Digest '04: SID International Symposium Digest of Technical Papers, 2004, vol. 35, pp. 82-85.

* cited by examiner

FIG. 11A

150

| 151A | 152A | 151B | 152B | 151C | 152C | 153 | 154 |
|---|---|---|---|---|---|---|---|
| R | BK | G | BK | B | BK | W | BK |
| BK | R | BK | G | BK | B | BK | W |
| G | BK | B | BK | R | BK | W | BK |
| BK | G | BK | B | BK | R | BK | W |
| B | BK | R | BK | G | BK | W | BK |
| BK | B | BK | R | BK | G | BK | W |

FIG. 11B

150

| 153 | 154 | 151A | 152A | 151B | 152B | 151C | 152C |
|---|---|---|---|---|---|---|---|
| W | BK | R | BK | G | BK | B | BK |
| BK | W | BK | R | BK | G | BK | B |
| W | BK | G | BK | B | BK | R | BK |
| BK | W | BK | G | BK | B | BK | R |
| W | BK | B | BK | R | BK | G | BK |
| BK | W | BK | B | BK | R | BK | G |

FIG. 12A

150

| 151A | 152A | 151B | 152B | 151C | 152C | 155 |
|---|---|---|---|---|---|---|
| R | BK | G | BK | B | BK | BK |
| BK | R | BK | G | BK | B | BK |
| G | BK | B | BK | R | BK | BK |
| BK | G | BK | B | BK | R | BK |

FIG. 12B

150

| 151A | 152A | 151B | 152B | 151C | 152C | 155 |
|---|---|---|---|---|---|---|
| R | BK | G | BK | B | BK | BK |
| BK | R | BK | G | BK | B | BK |
| G | BK | B | BK | R | BK | BK |
| BK | G | BK | B | BK | R | BK |
| B | BK | R | BK | G | BK | BK |
| BK | B | BK | R | BK | G | BK |

FIG. 12C

150

| 151A | 152A | 151B | 152B | 151C | 152C | 153 | 154 | 155 |
|---|---|---|---|---|---|---|---|---|
| R | BK | G | BK | B | BK | W | BK | BK |
| BK | R | BK | G | BK | B | BK | W | BK |
| G | BK | B | BK | R | BK | W | BK | BK |
| BK | G | BK | B | BK | R | BK | W | BK |

FIG. 12D

150

| 151A | 152A | 151B | 152B | 151C | 152C | 153 | 154 | 155 |
|---|---|---|---|---|---|---|---|---|
| R | BK | G | BK | B | BK | W | BK | BK |
| BK | R | BK | G | BK | B | BK | W | BK |
| G | BK | B | BK | R | BK | W | BK | BK |
| BK | G | BK | B | BK | R | BK | W | BK |
| B | BK | R | BK | G | BK | W | BK | BK |
| BK | B | BK | R | BK | G | BK | W | BK |

METHOD FOR DRIVING LIQUID CRYSTAL DISPLAY DEVICE

BACKGROUND OF THE INVENTION

1. Field of the Invention

The present invention relates to liquid crystal display devices, methods for driving a liquid crystal display device, and electronic devices including a liquid crystal display device.

2. Description of the Related Art

Liquid crystal display devices ranging from large display devices such as television receivers to small display devices such as mobile phones have been spreading. From now on, products with higher added values will be needed and are being developed. In recent years, in view of rising interest in the global environment and improvement of the convenience of mobile devices, development of liquid crystal display devices with lower power consumption has attracted attention. Thus, researches on display by a field sequential method (also referred to as a color sequential method, a time-division display method, or a successive additive color mixing method) have been developed.

In the field sequential method, backlights of red (hereinafter also abbreviated to R in some cases), green (hereinafter also abbreviated to G in some cases), and blue (hereinafter also abbreviated to B in some cases) are switched within a predetermined period, and light of R, G and B are supplied to a display panel. Therefore, a color filter is not necessarily provided for each pixel, and use efficiency of transmitting light from a backlight can be enhanced. Further, one pixel can express R, G, and B; therefore, the field sequential method has an advantage of improving definition easily.

Patent Document 1 discloses a liquid crystal display device in which images are displayed by a field sequential method.

REFERENCE

[Patent Document 1] Japanese Published Patent Application No. 2007-264211

SUMMARY OF THE INVENTION

As described in Patent Document 1, the field sequential method has a problem of a display defect caused by color breakup. It is known that the problem of color breakup can be eased by applying a structure in which input frequency of video signals per one-frame period is increased or a structure in which a non-light-emission period of a light source (a backlight) is provided in one frame period.

However, in a liquid crystal display device where display is performed by a field sequential method using, for example, three colors of red (R), green (G), and blue (B) as the colors of light sources (backlights), it is necessary to input video signals 180 times per second to each pixel when a frame frequency is set at 60 Hz (60 times per second). Further, in the case where the frequency of the frame is doubled by reason of, for example, providing a non-light-emission period of a light source, it is necessary to input video signals 360 times per second to each pixel.

A switching element and a liquid crystal element provided in each pixel should have high response speed in response to an increase in the input frequency of video signals. Therefore, the materials of the switching element and the liquid crystal element are limited.

Further, the structure which reduces color breakup only by providing a non-light-emission period of a light source in one frame period leads to a degradation in luminance of display images, which is not preferable.

An object of one embodiment of the present invention is to propose a novel structure which can reduce color breakup in a liquid crystal display device where display is performed by a field sequential method.

Another object of one embodiment of the present invention is to suppress color mixture in a boundary portion in light sources of a liquid crystal display device where display is performed by a field sequential method when light sources are divided into a plurality of regions and lights of a plurality of colors is emitted.

Further, another object of one embodiment of the present invention is to suppress a degradation in luminance of display images when a non-light-emission period is provided in the liquid crystal display device where display is performed by a field sequential method.

One embodiment of the present invention is a method for driving a field sequential liquid crystal display device including a backlight portion having a light source region which is divided into a first region, a second region, a third region, and a fourth region; and a pixel portion which is divided into a first pixel region, a second pixel region, a third pixel region, and a fourth pixel region corresponding to the first region, the second region, the third region, and the fourth region, respectively. In the driving method, one frame period includes a plurality of subframe periods including a first subframe period and a second subframe period. In the first subframe period, light emission is performed at the same time in the first region and the third region; non-light emission is performed at the same time in the second region and the fourth region, in which a color of light emission in the first region and a color of light emission in the third region are different from each other. In the second subframe period, light emission is performed at the same time in the second region and the fourth region; non-light emission is performed at the same time in the first region and the third region, in which a color of light emission in the second region and a color of light emission in the fourth region are different from each other. Light emission or non-light emission is performed in the first region and the third region, which are separated from each other with the second region interposed therebetween; and light emission or non-light emission is performed in the second region and the fourth region, which are separated from each other with the third region interposed therebetween.

Another embodiment of the present invention is a method for driving a field sequential liquid crystal display device including a backlight portion having a light source region which is divided into a first region, a second region, a third region, a fourth region, a fifth region, and a sixth region; and a pixel portion which is divided into a first pixel region, a second pixel region, a third pixel region, a fourth pixel region, a fifth pixel region, and a sixth pixel region corresponding to the first region, the second region, the third region, the fourth region, the fifth region, and the sixth region, respectively. In the driving method, one frame period includes a plurality of subframe periods including a first subframe period and a second subframe period. In the first subframe period, light emission is performed at the same time in the first region, the third region, and the fifth region; non-light emission is performed at the same time in the second region, the fourth region, and the sixth region, in which a color of light emission in the first region, a color of light emission in the third region, and a color of light emission in the fifth region are different from one another. In the second subframe period, light emission is performed at the same time in the second region, the fourth region, and the sixth region; non-light emission is performed at the same time in the first region, the third region, and the fifth region, in which a color of light emission in the second region, a color of light emission in the fourth region, and a color of light emission in the sixth region are different from one another. Light emission or non-light emission is performed in the first region and the third region, which are separated from each other with the second region interposed therebetween; light emission or non-light emission is performed in the second region and the fourth region, which are separated from each other with the third region interposed therebetween; light emission or non-light emission is performed in the third region and the fifth region, which are separated from each other with the fourth region interposed therebetween; and light emission or non-light emission is performed in the fourth region and the sixth region, which are separated from each other with the fifth region interposed therebetween.

Another embodiment of the present invention is a method for driving a field sequential liquid crystal display device including a backlight portion having a light source region which is divided into a first region, a second region, a third region, and a fourth region; and a pixel portion which is divided into a first pixel region, a second pixel region, a third pixel region, and a fourth pixel region corresponding to the first region, the second region, the third region, and the fourth region, respectively. In the driving method, one frame period includes a plurality of subframe periods including a first subframe period, a second subframe period, a third subframe period, and a fourth subframe period. In the first subframe period, light emission is performed at the same time in the first region and the third region; non-light emission is performed at the same time in the second region and the fourth region, in which a color of light emission in the first region and the a color of light emission in third region are different from each other. In the second subframe period, light emission is performed at the same time in the second region and the fourth region; non-light emission is performed at the same time in the first region and the third region, in which a color of light emission in the second region and a color of light emission in the fourth region are different from each other. In the third subframe period, light emission is performed at the same time in the first region and the third region; non-light emission is performed at the same time in the second region and the fourth region, in which a color of light emission in the first region and a color of light emission in the third region are each white. In the fourth subframe period, light emission is performed at the same time in the second region and the fourth region; non-light emission is performed at the same time in the first region and the third region, in which a color of light emission in the second region and a color of light emission in the fourth region are each white. Light emission or non-light emission is performed in the first region and the third region, which are separated from each other with the second region interposed therebetween; and light emission or non-light emission is performed in the second region and the fourth region, which are separated from each other with the third region interposed therebetween.

Another embodiment of the present invention is a method for driving a field sequential liquid crystal display device including a backlight portion having a light source region which is divided into a first region, a second region, a third region, a fourth region, a fifth region, and a sixth region; and a pixel portion which is divided into a first pixel region, a second pixel region, a third pixel region, a fourth pixel region, a fifth pixel region, and a sixth pixel region corresponding to the first region, the second region, the third region, the fourth region, the fifth region, and the sixth region, respectively. In the driving method, one frame period includes a plurality of subframe periods including a first subframe period, a second subframe period, a third subframe period, and a fourth subframe period. In the first subframe period, light emission is performed at the same time in the first region, the third region, and the fifth region; non-light emission is performed at the same time in the second region, the fourth region, and the sixth region, in which a color of light emission in the first region, a color of light emission in the third region, and a color of light emission in the fifth region are different from one another. In the second subframe period, light emission is performed at the same time in the second region, the fourth region, and the sixth region; non-light emission is performed at the same time in the first region, the third region, and the fifth region, in which a color of light emission in the second region, a color of light emission in the fourth region, and a color of light emission in the sixth region are different from one another. In the third subframe period, light emission is performed at the same time in the first region, the third region, and the fifth region; non-light emission is performed at the same time in the second region, the fourth region, and the sixth region, in which a color of light emission in the first region, a color of light emission in the third region, and a color of light emission in the fifth region are each white. In the fourth subframe period, light emission is performed at the same time in the second region, the fourth region, and the sixth region; non-light emission is performed at the same time in the first region, the third region, and the fifth region, in which a color of light emission in the second region, a color of light emission in the fourth region, and a color of light emission in the sixth region are each white. Light emission or non-light emission is performed in the first region and the third region, which are separated from each other with the second region interposed therebetween; light emission or non-light emission is performed in the second region and the fourth region, which are separated from each other with the third region interposed therebetween; light emission or non-light emission is performed in the third region and the fifth region, which are separated from each other with the fourth region interposed therebetween; and light emission or non-light emission is performed in the fourth region and the sixth region, which are separated from each other with the fifth region interposed therebetween.

One embodiment of the present invention may be the method for driving a liquid crystal display device, in which, color display is performed by emitting light of colors for performing color display by the light emission of the light sources where the first subframe period and the second subframe period are repeated.

One embodiment of the present invention may be the method for driving a liquid crystal display device, in which the colors for performing color display is red, green, and blue.

One embodiment of the present invention may be the method for driving a liquid crystal display device, in which the third subframe period and the fourth subframe period are successively provided in an initial period or a last period of the one-frame period.

One embodiment of the present invention may be the method for driving a liquid crystal display device, in which the white is obtained by performing at the same time light emission of light sources whose colors which are complementary to each other are combined or by emitting lights at the same time from red, green, and blue light sources.

One embodiment of the present invention may be the method for driving a liquid crystal display device, in which the plurality of subframe periods is provided with a fifth subframe period in which all of the light sources emit no light.

According to one embodiment of the present invention, color breakup can be reduced without an increase in frame frequency in a liquid crystal display device where display is performed by a field sequential method.

According to another embodiment of the present invention, color mixture in a boundary portion of light sources can be suppressed and display quality can be improved in a liquid crystal display device where display is performed by a field sequential method when light sources are divided into a plurality of regions and lights of a plurality of colors are emitted.

According to another embodiment of the present invention, when a non-light-emission period is provided in a liquid crystal display device where display is performed by a field sequential method, a degradation in luminance of display images can be suppressed and power consumption can be reduced.

BRIEF DESCRIPTION OF THE DRAWINGS

FIGS. 11A and 11B are timing charts of one embodiment of the present invention.

FIGS. 12A to 12D are timing charts of one embodiment of the present invention.

DETAILED DESCRIPTION OF THE INVENTION

Figure 1A:
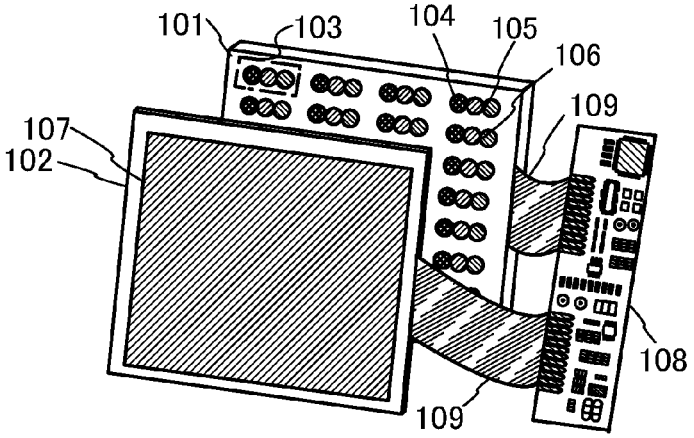
FIG. 1A is a perspective view.

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Therefore, the present invention is not interpreted as being limited to the description of the embodiments below. Note that in structures of the present invention described below, reference numerals denoting the same portions are used in common in different drawings.

Note that the size, the thickness of a layer, distortion of the waveform of a signal, and a region of each structure illustrated in the drawings and the like in the embodiments are exaggerated for simplicity in some cases. Therefore, embodiments of the present invention are not necessarily limited to such scales.

Note that in this specification, terms such as "first", "second", and "third" to "nth" (n is a natural number) are used in order to avoid confusion among components, and the terms do not limit the components numerically.

Embodiment 1

First, FIG. 1A is a perspective view illustrating part of the internal structure of a liquid crystal display device. The liquid crystal display device in FIG. 1A includes a backlight portion 101 and a display panel 102.

Note that FIG. 1A illustrates the state in which light emitted from the backlight portion 101 passes through liquid crystal elements in the display panel 102 and is seen by an observer. Thus, although the backlight portion 101 is referred to as a "backlight" for the description in this embodiment, the backlight portion 101 can also be referred to as "front light" or "side light" depending on a method by which emitted light is guided.

Note that in some cases, one side or both sides of the display panel 102 of the liquid crystal are provided with a polarizing plate depending on a liquid crystal mode to be used. In addition, in some cases, a diffuser plate is provided between the display panel 102 and the backlight portion 101 in order to bring evenness of light emitted from the backlight portion 101.

In the backlight portion 101, backlight units 103 in each of which light sources with colors for color display are combined are arranged in a matrix. For example, the respective backlight units 103 include a red (R) light source 104, a green (G) light source 105, and a blue (B) light source 106. Note that power consumption can be reduced when a light-emitting diode (LED) is used for the light sources 104 to 106. The display panel 102 includes a pixel portion 107 provided with a plurality of pixels. Note that in the structure of this embodiment where display is performed by a field sequential method, light is emitted sequentially from the red (R) light source 104, the green (G) light source 105, and to the blue (B) light source 106 of the backlight unit 103 in order to perform display.

In the backlight unit 103 of the backlight portion 101, the luminance of the light sources of the respective colors can be switched in accordance with video signals. The luminance of the light sources of the respective colors may be increased or reduced between the light sources of the same color in the backlight portion 101. With the above structure, the contrast ratio of an image to be displayed can be enhanced.

Note that although the backlight unit has the light sources of three colors, RGB, in this embodiment, another kind of light source may be combined. For example, in addition to the light sources of three colors, RGB, a white light source, a yellow light source, a magenta light source, a cyan light source, or the like may be used.

Note that a light-emitting diode which emits white light may be used for a white light source. As the light-emitting diode which emits white light, a three-band white light-emitting diode in which a light-emitting diode of a primary color and a fluorescent material are combined may be used, or a white light source in which white light emission can be obtained from light emission from a blue light-emitting diode and light emission from a fluorescent material which emits light of yellow that is a color complementary to blue may be used. Note that a white light source may be formed by emitting lights at the same time from the light sources of three colors, RGB.

The display panel 102 may include a scan line driver circuit (also referred to as a gate line driver circuit) and a data line driver circuit (also referred to as a signal line driver circuit) in addition to the pixel portion 107. Each of the pixels in the pixel portion 107 includes a transistor which is a switching element and a liquid crystal element. In the transistor, a gate terminal is connected to a scan line, a first terminal is connected to a data line, and a second terminal is connected to a liquid crystal element. The potential of the data line is supplied to a first electrode of the liquid crystal element through the transistor. In addition, a common potential is supplied to a second electrode of the liquid crystal element. A liquid crystal material interposed between the first electrode and the second electrode controls light transmittance from the backlight portion 101 according to an electric field between the first electrode and the second electrode.

The backlight portion 101 and the display panel 102 are electrically connected to each other by an external circuit 108 provided with a display control circuit or the like and flexible printed circuits (FPCs) 109 serving as external input terminals.

Note that a pixel is a display unit which can control the brightness of lights from the light sources of the backlight portion 101. In the structure of this embodiment where display is performed by a field sequential method, a color image is displayed in such a manner that the brightness of lights from the red (R) light sources 104, the green (G) light sources 105, and the blue (B) light sources 106 of the backlight units 103 is controlled in terms of time by each pixel so that viewers recognize by an additive color mixture the colors of the light sources of the backlight units 103.

Note that a transistor is an element having at least three terminals of a gate, a drain, and a source. The transistor includes a channel region between a drain region and a source region, and current can flow through the drain region, the channel region, and the source region. Here, since the source and the drain of the transistor may change depending on the structure, the operating condition, and the like of the transistor, it is difficult to define which is a source or a drain. Thus, in this specification, a region functioning as a source and a drain may not be called the source or the drain. In such a case, for example, one of the source and the drain may be referred to as a first terminal and the other thereof may be referred to as a second terminal. Alternatively, one of the source and the drain may be referred to as a first electrode (terminal) and the other thereof may be referred to as a second electrode (terminal). Further alternatively, one of the source and the drain may be referred to as a source region and the other thereof may be referred to as a drain region. Still further alternatively, one of the source and the drain may be referred to as a source terminal and the other thereof may be referred to as a drain terminal.

The structure of the transistor provided in the pixel may be an inverted-staggered structure or a staggered structure. Alternatively, a double-gate structure may be used in which a channel region is divided into a plurality of regions and the divided channel regions are connected in series. Alternatively, a dual-gate structure may be used in which gate electrodes are provided over and under the channel region. Further, the transistor element may be used in which a semiconductor layer is divided into a plurality of island-shaped semiconductor layers and which realizes switching operation.

Figure 1B:
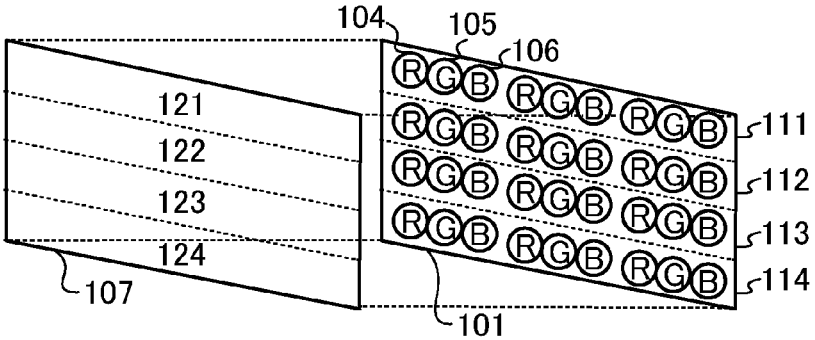
FIGS. 1B and 1C are schematic diagrams.

Next, FIG. 1B is a schematic diagram of the backlight portion 101 and the pixel portion 107 in the perspective view of FIG. 1A.

In the schematic diagram of FIG. 1B, the light sources of the backlight portion 101, that is, a region where the backlight units 103 are provided (referred to as a light source region) includes a first region 111, a second region 112, a third region 113, and a fourth region 114. The first regions to the fourth regions 114 each include a plurality of red (R) light sources 104, green (G) light sources 105, and blue (B) light sources 106. Three light sources each of a different color may be combined in each backlight unit 103.

It is preferable that the first region 111 to the fourth region 114 be each a region which is formed by division of the light source region of the backlight portion 101 in a direction parallel to a scan line so that the driving method of this embodiment is not complicated.

In the schematic diagram of FIG. 1B, the pixel portion 107 includes a first pixel region 121, a second pixel region 122, a third pixel region 123, and a fourth pixel region 124 which correspond to the above first region 111, second region 112, third region 113, and fourth region 114, respectively. The first pixel region 121, the second pixel region 122, the third pixel region 123, and the fourth pixel region 124 are regions which are formed by the division in a direction parallel to a scan line which correspond to the first region 111, the second region 112, the third region 113, and the fourth region 114, respectively. Thus, the number of the first pixel region 121 to the fourth pixel region 124 is the same as the number of the first region 111 to the fourth region 114.

Note that it is preferable that the number of backlight units 103 in the first region 111 to the fourth region 114 be the same as the number of pixels in the first pixel region 121 to the fourth pixel region 124. However, the number of pixels is normally larger than the number of backlight units 103. Thus, the backlight units 103 adjust luminance of the light sources of the respective colors included in the backlight units 103 which correspond to a plurality of pixels in the first pixel region 121 to the fourth pixel region 124.

Figure 1C:
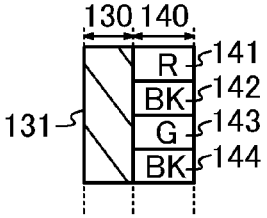

Next, a writing period in which video signals are written to the first pixel region 121 to the fourth pixel region 124 and light emission or non-light-emission of the backlight units 103 in the first region 111 to the fourth region 114 are described. FIG. 1C is a schematic diagram for illustrating a timing chart of this embodiment.

FIG. 1C illustrates a writing period 130 and a light emission period 140. FIG. 1C illustrates a writing operation 131 to each row and each column of the first pixel region 121 to the fourth pixel region 124, a light emission or non-light-emission operation 141 in the first region 111, a light emission or non-light-emission operation 142 in the second region 112, a light emission or non-light-emission operation 143 in the third region 113, and a light emission or non-light-emission operation 144 in the fourth region 114. Note that in FIG. 1C, after the writing operation 131 to the first pixel region 121 to the fourth pixel region 124 is completed, the operation 141 to the operation 144 are performed at the same time.

The writing operation 131 in FIG. 1C may be any operation as long as video signals corresponding to the operations 141 to 144 are written. For example, a structure in which a video signal is sequentially written to each row and each column of the pixel portion 107 may be employed, or a structure in which a video signal is selectively written to any of the first pixel region 121 to the fourth pixel region 124 which each correspond to a region where an operation of emitting lights of light sources of the backlight portion 101 is performed may be employed.

The operation 141 in FIG. 1C represents light emission using the red (R) light sources. In other words, in the operation 141, the red (R) light sources 104 of the backlight units 103 in the first region 111 emit lights. The operation 143 represents light emission using the green (G) light sources. In other words, in the operation 143, the green (G) light sources 105 of the backlight units 103 in the third region 113 emit lights.

In the following description as in FIGS. 1C, R, G, and B in timing charts denote an operation in which the red (R) light sources 104 of the backlight units 103 emit lights, an operation in which the green (G) light sources 105 of the backlight units 103 emit lights, and an operation in which the blue (B) light sources 106 of the backlight units 103 emit lights are performed, respectively. Note that the above description of FIG. 1C is similar in the case of another color, for example, white (W).

The operation 142 and the operation 144 in FIG. 1C each represent non-light emission of the RGB light sources, that is, black display (BK) is performed. In other words, in the operation 142 and the operation 144, the RGB light sources of the backlight units 103 in the second region 112 and the fourth region 114 emit no light all at once.

In the following description as in FIG. 1C, black display, that is, an operation of performing non-light emission of the RGB light sources of the backlight units is performed by showing BK in a period corresponding to the light emission period 140 in FIG. 1C.

In a structure of this embodiment described below, light emission or non-light-emission periods in the operations 141 to 144 are described as subframe periods. As an example, in this embodiment, a first subframe period refers to a period in which light sources of the first region 111 and the third region 113 emit lights and light sources of the second region 112 and the fourth region 114 emit no light. A second subframe period refers to a period in which light sources of the first region 111 and the third region 113 emit no light and light sources of the second region 112 and the fourth region 114 emit lights. Note that in practice, the period in which light sources of the first region 111 to the fourth region 114 emit lights is in a range the same as or narrower than the range of the first subframe period and the second subframe period.

Note that the driving method of a liquid crystal display device, which is described in this embodiment, can have a structure in which the writing period 130 and the light emission period 140 overlap with each other. In other words, in the driving method of a liquid crystal display device, which is described in this embodiment, a period needed only for writing a video signal can be hidden by overlapping with a period in which the light sources in the light emission period 140 emit no light. For example, in the period (BK) in which light sources of the second region 112 and the fourth region 114 of the first subframe periods emit no light and the period (BK) in which light sources of the first region 111 and the third region 113 of the second subframe periods emit no light, a video signal of a region in which a light source emits light in a subsequent period can be written; thus, a period needed only for writing a video signal can not be seen. Thus, the structure of this embodiment can be described without illustrating the writing operation of the writing period 130. In this case, video signals are written in a frame period just before the first subframe period, in which light sources of the first region 111 to the fourth region 114 emit no light.

Note that in the structure in which the writing period 130 and the light emission period 140 overlap with each other, it is preferable that the length of the light emission period 140 be set longer than the length of the period needed only for writing a video signal.

Figure 1D:
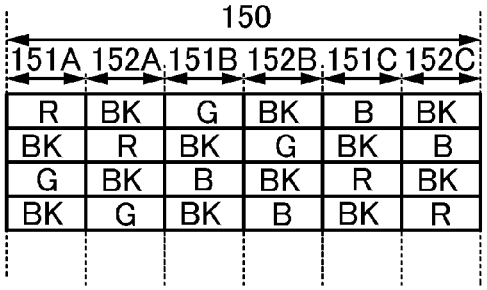
FIG. 1D is a timing chart of one embodiment of the present invention.

Next, FIG. 1D is a timing chart of a plurality of subframe periods included in one frame period. One frame period 150 in the timing chart in FIG. 1D can be roughly divided into a first subframe period 151A, a first subframe period 151B, and a first subframe period 151C and a second subframe period 152A, a second subframe period 152B, and a second subframe period 152C. Note that video signals of the first subframe period 151A are written in a frame period just before the first subframe period 151A, in which RGB light sources of backlight units emit no light.

Note that the first subframe period is divided into three subframe periods, i.e., the first subframe period 151A, the first subframe period 151B, and the first subframe period 151C; and the second subframe period is divided into three subframe periods, i.e., the second subframe period 152A, the second subframe period 152B, and the second subframe period 152C. This is because the number of subframes is based on the number of colors of light sources included in the backlight unit 103 for color display. Thus, the number of first subframes and the number of second subframes are not particularly limited.

In the first subframe period 151A, the first subframe period 151B, and the first subframe period 151C in FIG. 1D, the light sources of the first region 111 and the light sources of the third region 113 emit lights at the same time by the operation 141 and the operation 143, respectively. In addition, in the first subframe period 151A, the first subframe period 151B, and the first subframe period 151C in FIG. 1D, the light sources in the first region 111 and the light sources in the third region 113 emit lights of different colors.

In the specific example in FIG. 1D, in the first subframe period 151A in the first region 111, the red (R) light sources 104 of the backlight units 103 emit lights. In the first subframe period 151A in the third region 113, the green (G) light sources 105 of the backlight units 103 emit lights. In the first subframe period 151B in the first region 111, the green (G) light sources 105 of the backlight units 103 emit lights. In the first subframe period 151B in the third region 113, the blue (B) light sources 106 of the backlight units 103 emit lights. In the first subframe period 151C in the first region 111, the blue (B) light sources 106 of the backlight units 103 emit lights. In the first subframe period 151C in the third region 113, the red (R) light sources 104 of the backlight units 103 emit lights.

In the first subframe period 151A, the first subframe period 151B, and the first subframe period 151C in FIG. 1D, the light sources of the second region 112 and the light sources of the fourth region 114 emit no light at the same time by the operation 142 and the operation 144, respectively.

In the second subframe period 152A, the second subframe period 152B, and the second subframe period 152C each of which is provided after the first subframe period in FIG. 1D, the light sources of the second region 112 and the light sources of the fourth region 114 emit lights at the same time by the operation 142 and the operation 144, respectively. In addition, in the second subframe period 152A, the second subframe period 152B, and the second subframe period 152C in FIG. 1D, the light sources in the second region 112 and the light sources in the fourth region 114 emit lights of different colors.

In the specific example in FIG. 1D, in the second subframe period 152A in the second region 112, the red (R) light sources 104 of the backlight units 103 emit lights. In the second subframe period 152A in the fourth region 114, the green (G) light sources 105 of the backlight units 103 emit lights. In the second subframe period 152B in the second region 112, the green (G) light sources 105 of the backlight units 103 emit lights. In the second subframe period 152B in the fourth region 114, the blue (B) light sources 106 of the backlight units 103 emit lights. In the second subframe period 152C in the second region 112, the blue (B) light sources 106 of the backlight units 103 emit lights. In the second subframe period 152C in the fourth region 114, the red (R) light sources 104 of the backlight units 103 emit lights.

In the second subframe period 152A, the second subframe period 152B, and the second subframe period 152C each of which is provided after the first subframe period in FIG. 1D, the light sources of the first region 111 and the light sources of the third region 113 emit no light at the same time by the operation 141 and the operation 143, respectively.

As described in the above description of FIG. 1D, the driving method of this embodiment has a structure in which light emission of different colors is performed in regions where light sources emit lights at the same time in the first subframe periods and the second subframe periods; and the regions where the light sources emit lights at the same time are separated from each other, with a region where light sources emit no light at the same time interposed therebetween. Therefore, color mixture in a boundary portion of light sources can be suppressed and display quality can be improved in a liquid crystal display device where display is performed by a field sequential method when light sources of the backlight portion 101 are divided into a plurality of regions and lights of a plurality of colors are emitted.

In the driving method of this embodiment, the light sources of the backlight portion 101 in the subframe periods do not have single colors but have a plurality of colors in a plurality of regions. Therefore, lacking only data of any of the colors of light sources of a plurality of colors for color display, which is caused by blink of a user, is less likely to occur; thus, color breakup can be reduced without an increase in frame frequency.

Note that although FIG. 1D has a structure in which the second subframe period 152A, the second subframe period 152B, and the second subframe period 152C, which follow the first subframe period 151A, the first subframe period 151B, and the first subframe period 151C, respectively, another structure may be employed.

Note that the writing order of RGB video signals and light emission order of the RGB light sources in the first subframe period 151A, the first subframe period 151B, and the first subframe period 151C and the second subframe period 152A, the second subframe period 152B, and the second subframe period 152C in FIG. 1D are not particularly limited. The writing order of the video signals and light emission order of the light sources may be random orders by using the random number or the like as long as predetermined RGB video signals are written in the one-frame period 150. With the above structure, color breakup can be reduced as compared to the structure in which RGB video signals are written regularly and RGB light sources emit lights regularly.

Figure 2:
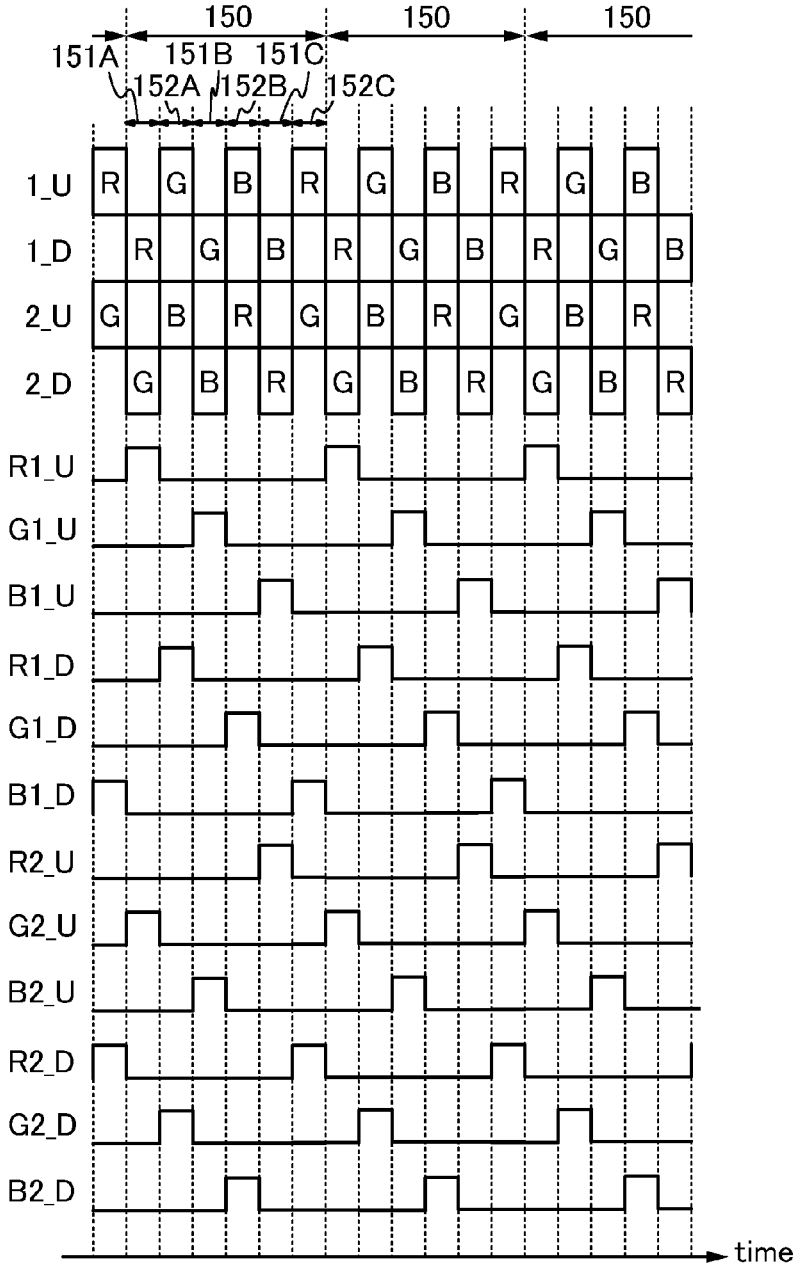
FIG. 2 is a timing chart of one embodiment of the present invention.

Next, FIG. 2 shows an example of detailed waveforms of the timing chart in FIG. 1D. Note that in the timing chart in FIG. 2, the length of a writing period is made half by sequentially performing light emission of light sources in a pixel region where video signals are written and writing at the same time video signals of the first pixel region 121 and the third pixel region 123 and video signals of the second pixel region 122 and the fourth pixel region 124.

In the timing chart in FIG. 2, writing of video signals to the first pixel region 121 is denoted by "1_U". In the timing chart in FIG. 2, writing of video signals to the second pixel region 122 is denoted by "1_D". In the timing chart in FIG. 2, writing of video signals to the third pixel region 123 is denoted by "2_U". In the timing chart in FIG. 2, writing of video signals to the fourth pixel region 124 is denoted by "2_D".

In the timing chart in FIG. 2, R, G, and B in "1_U", "1_D", "2_U", and "2_D" express writing of video signals of color elements of R, G, and B, respectively.

In the timing chart in FIG. 2, red (R) light sources 104 of the backlight units in the first region 111 emit lights at a potential of a high level and emit no light at a potential of a low level (R1_U). In the timing chart in FIG. 2, green (G) light sources 105 of the backlight units in the first region 111 emit lights at a potential of a high level and emit no light at a potential of a low level (G1_U). In the timing chart in FIG. 2, a blue (B) light sources 106 of the backlight units in the first region 111 emit lights at a potential of a high level and emit no light at a potential of a low level (B1_U).

In the timing chart in FIG. 2, red (R) light sources 104 of the backlight units in the second region 112 emit lights at a potential of a high level and emit no light at a potential of a low level (R1_D). In the timing chart in FIG. 2, green (G) light sources 105 of the backlight units in the second region 112 emit lights at a potential of a high level and emit no light at a potential of a low level (G1_D). In the timing chart in FIG. 2, blue (B) light sources 106 of the backlight units in the second region 112 emit lights at a potential of a high level and emit no light at a potential of a low level (B1_D).

In the timing chart in FIG. 2, red (R) light sources 104 of the backlight units in the third region 113 emit lights at a potential of a high level and emit no light at a potential of a low level (R2_U). In the timing chart in FIG. 2, green (G) light sources 105 of the backlight units in the third region 113 emit lights at a potential of a high level and emit no light at a potential of a low level (G2_U). In the timing chart in FIG. 2, blue (B) light sources 106 of the backlight units in the third region 113 emit lights at a potential of a high level and emit no light at a potential of a low level (B2_U).

In the timing chart in FIG. 2, red (R) light sources 104 of the backlight units in the fourth region 114 emit lights at a potential of a high level and emit no light at a potential of a low level (R2_D). In the timing chart in FIG. 2, green (G) light sources 105 of the backlight units in the fourth region 114 emit lights at a potential of a high level and emit no light at a potential of a low level (G2_D). In the timing chart in FIG. 2, blue (B) light sources 106 of the backlight units in the fourth region 114 emit lights at a potential of a high level and emit no light at a potential of a low level (B2_D).

Next, the operation of the first subframe period 151A in the above described timing chart of FIG. 2 is specifically described. Note that in a frame period just before the first subframe period 151A, an R video signal is written in 1_U and a G video signal is written in 2_U.

In the first subframe period 151A, R1_U and G2_U are changed from a low level to a high level, and the red (R) light sources 104 of the backlight units in the first region 111 and the green (G) light sources 105 of the backlight units in the third region 113 emit lights. At this time, video signals are written to the second pixel region 122 and the fourth pixel region 124 corresponding to the second region 112 and the fourth region 114, respectively, the light sources of which emit lights in the second subframe period 152A which is a subsequent subframe period. In other words, an R video signal is written in 1_D and a G video signal is written in 2_D. Operations of other subframe periods may be performed as illustrated in FIG. 2.

Next, a block diagram for illustrating driving of the liquid crystal display device is described. As in the perspective view in FIG. 1A, the block diagram in FIG. 3 illustrates the backlight portion 101, the display panel 102, and the external circuit 108.

Figure 3:
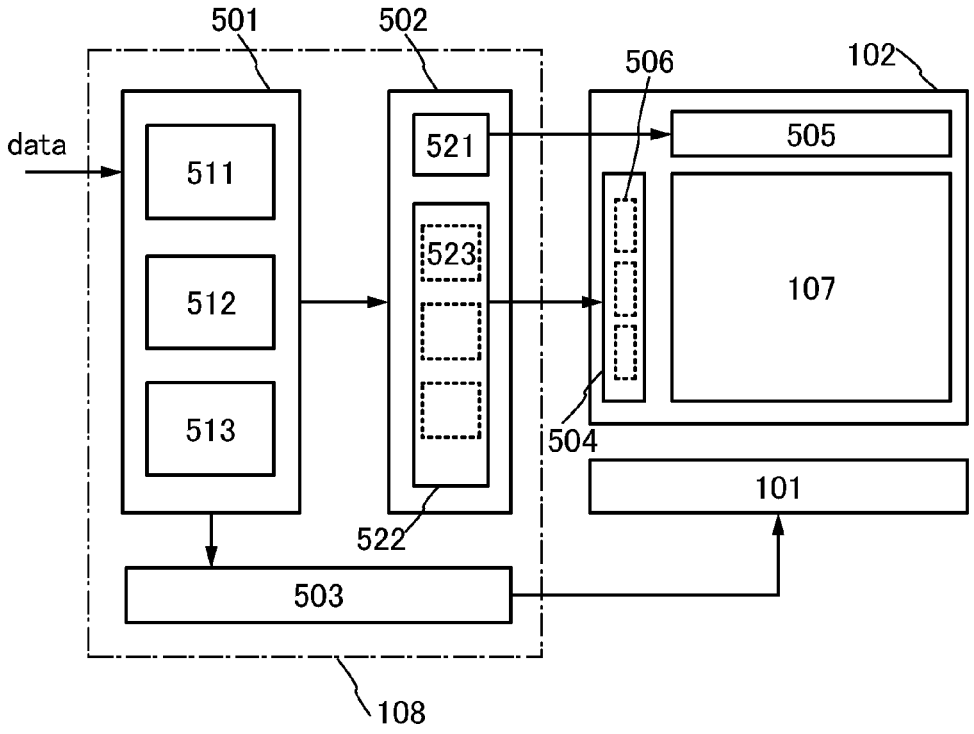
FIG. 3 is a block diagram of one embodiment of the present invention.

The external circuit 108 of the block diagram in FIG. 3 includes a video signal processing circuit 501 to which a video control signal and a video signal ("data" in FIG. 3) are input from the outside, a display panel control circuit 502, and a backlight control circuit 503. The display panel 102 of the block diagram in FIG. 3 includes a scan line driver circuit 504, a data line driver circuit 505, and the pixel portion 107.

Note that as described above, in the display panel 102, the scan line driver circuit 504 and the data line driver circuit 505 are not necessarily formed over the same substrate as the pixel portion 107.

The video signal processing circuit 501 includes a video signal memory circuit 511, a video signal processing circuit 512, and a field sequential driving control circuit 513.

The scan line driver circuit 504 includes a plurality of divided scan line driver circuit (hereinafter referred to as a divided scan line driver circuit 506) in a method in which pixels of each row in a plurality of pixel regions of the pixel portion 107 are selected at the same time and driven.

The display panel control circuit 502 includes a data line driving control circuit 521 and a gate line driving control circuit 522.

In the structure in which the scan line driver circuit 504 includes the divided scan line driver circuit 506, the gate line driving control circuit 522 may include a scan line divided driving control circuit 523 in accordance with the divided scan line driver circuit 506.

The video signal memory circuit 511 is a circuit for storing video signal data input from the outside and controlling input and output of the stored video signal data. Specifically, the video signal memory circuit 511 includes a frame memory for storing video signal data corresponding to several frames with the use of a volatile memory or a nonvolatile memory.

The video signal processing circuit 512 is a circuit for adjusting and/or converting the intensity of the input video signal data of each color component. Specifically, when the input video signal data are video signals of RGB color signals, the video signal processing circuit 512 is a circuit for performing image processing such as a gamma correction or luminance conversion on each color by reading the video signals which are once stored in the video signal memory circuit 511 and converting the video signals into video signals of predetermined colors. Note that the video signals of predetermined colors may be a combination of RGB and any one of white, yellow, magenta, and cyan or a plurality of colors, or may be a combination of RGB and another color. However, the video signals of predetermined colors correspond to the video signals of the colors of light sources included in a backlight unit.

Note that the video signal processing circuit 512 may include a memory circuit for storing a lookup table or the like for adjusting and/or converting the intensity of the input video signal data of each color component.

The field sequential driving control circuit 513 is a circuit for outputting the adjusted and/or converted video signal, which is obtained in the video signal processing circuit 512, to the display panel control circuit 502 at a predetermined timing in order to perform display by a field sequential method. Further, the field sequential driving control circuit 513 is a circuit for controlling the backlight control circuit 503 in accordance with the output of the adjusted and/or converted video signal, which is obtained in the video signal processing circuit 512, to the display panel control circuit 502. By the field sequential driving control circuit 513, writing the video signals in the pixel portion 107 and light emission of light sources of the backlight portion 101 can be synchronized.

The backlight control circuit 503 is a circuit for generating signals for performing light emission of light sources included in the backlight unit of the backlight portion 101 in accordance with the above video signals and outputting the signals to the backlight portion 101.

The data line driving control circuit 521 is a circuit for outputting a clock signal, a start pulse, or the like to the data line driver circuit 505 in order to display the pixel portion which is synchronized with the light emission of light sources of the backlight portion 101. The gate line driving control circuit 522 is a circuit for outputting a clock signal, a start pulse, or the like to the scan line driver circuit 504 in order to display the pixel portion which is synchronized with the light emission of light sources of the backlight portion 101.

Figure 4:
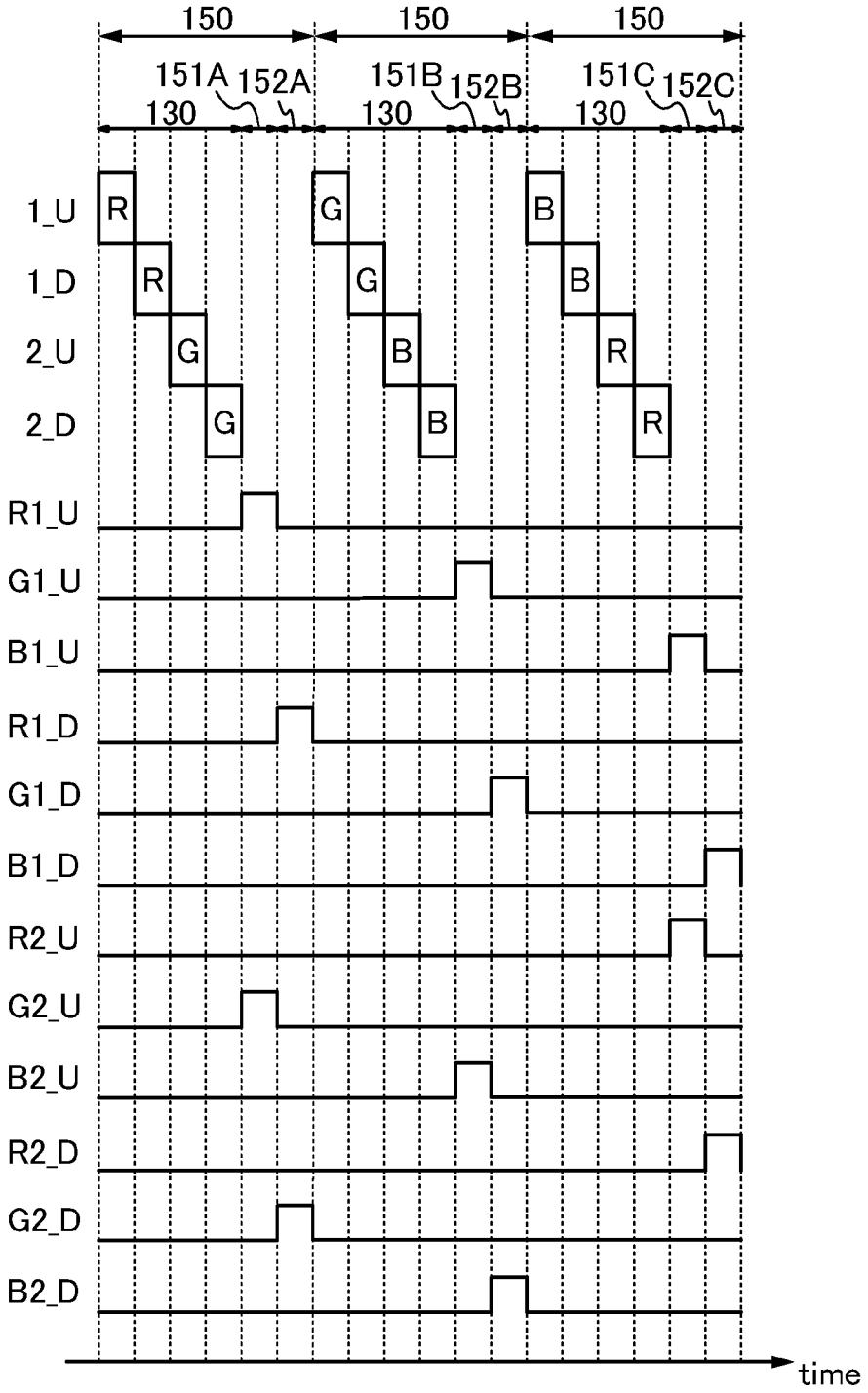
FIG. 4 is a timing chart of one embodiment of the present invention.

Next, FIG. 4 is a timing chart different from the timing chart of FIG. 2. Note that the timing chart in FIG. 4 differs from the timing chart in FIG. 2 in that a first subframe period and a second subframe period to be a light emission period 140 are provided after a writing period 130 where a video signal is written to each row and each column of the pixel portion. In other words, by providing the first subframe period and the second subframe period apart from the writing period, a structure of a driver circuit which is needed to write video signals can be simplified without having a complicated structure in which, for example, video signals of different pixel regions are written at the same time.

In the timing chart in FIG. 4 as in the timing chart in FIG. 2, "1_U", "1_D", "2_U", and "2_D" express writing of video signals, and "R1_U", "G1_U", "B1_U", "R1_D", "G1_D", "B1_D", "R2_U", "G2_U", "B2_U", "R2_D", "G2_D", and "B2_D" express light emission of light sources.

Specific operations of the timing chart in FIG. 4 are described herein. First, in the writing period 130, an R video signal is written in 1_U, an R video signal is written in 1_D, a G video signal is written in 2_U, and then a G video signal is written in 2_D. Next, in a first subframe period 151A, R1_U and G2_U are changed from a low level to a high level, and the red (R) light sources 104 of the backlight units in the first region 111 and the green (G) light sources 105 of the backlight units in the third region 113 emit lights. In a second subframe period 152A, R1_D and G2_D are changed from a low level to a high level, and the red (R) light sources 104 of the backlight units in the second region 112 and the green (G) light sources 105 of the backlight units in the fourth region 114 emit lights. Operations of other subframe periods may be performed as illustrated in FIG. 4.

Figure 5:
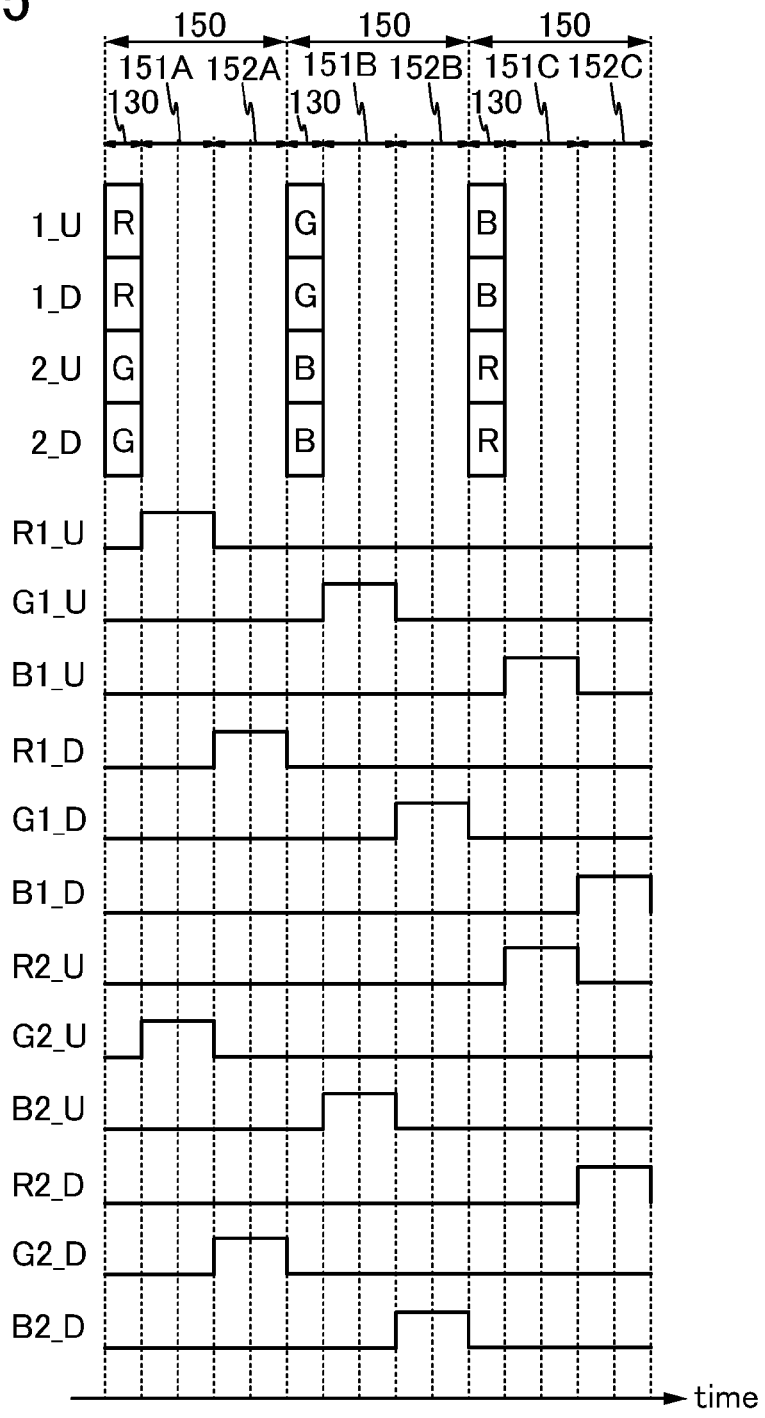
FIG. 5 is a timing chart of one embodiment of the present invention.

Next, FIG. 5 is a timing chart different from the timing charts of FIG. 2 and FIG. 4. Note that in the timing chart in FIG. 5, a writing period is made much shorter and instead a light emission period is made longer by writing at the same time video signals of divided pixel regions. In other words, one frame period can be shortened because a first subframe period and a second subframe period can be shortened; therefore, it can be expected that color breakup due to an increase in frame frequency be reduced. Moreover, it can be expected that luminance be improved by lengthening a light emission period.

In the timing chart in FIG. 5 as in the timing charts in FIG. 2 and FIG. 4, "1_U", "1_D", "2_U", and "2_D" express writing of video signals, and "R1_U", "G1_U", "B1_U", "R1_D", "G1_D", "B1_D", "R2_U", "G2_U", "B2_U", "R2_D", "G2_D", and "B2_D" express light emission of light sources.

Specific operations of the timing chart in FIG. 5 are described herein. First, in a writing period 130, an R video signal is written in 1_U, an R video signal is written in 1_D, a G video signal is written in 2_U, and a G video signal is written in 2_D. These writings are performed at the same time. Next, in a first subframe period 151A, R1_U and G2_U are changed from a low level to a high level, and the red (R) light sources 104 of the backlight units in the first region 111 and the green (G) light sources 105 of the backlight units in the third region 113 emit lights. In a second subframe period 152A, R1_D and G2_D are changed from a low level to a high level, and the red (R) light sources 104 of the backlight units in the second region 112 and the green (G) light sources 105 of the backlight units in the fourth region 114 emit lights. Operations of other subframe periods may be performed as illustrated in FIG. 5.

As described above, the driving method of this embodiment has a structure in which light emission of different colors is performed in regions where light sources emit lights at the same time in the first subframe periods and the second subframe periods; and the regions where the light sources emit lights at the same time are separated from each other, with a region where light sources emit no light at the same time interposed therebetween. Therefore, color mixture in a boundary portion of light sources can be suppressed and display quality can be improved in a liquid crystal display device where display is performed by a field sequential method when light sources of the backlight portion are divided into a plurality of regions and lights of a plurality of colors are emitted.

In the driving method of this embodiment, the light sources of the backlight portion in the subframe periods do not have single colors but have a plurality of colors in a plurality of regions. Therefore, lacking only data of any of the colors of light sources of a plurality of colors for color display, which is caused by blink of a user, is less likely to occur; thus, color breakup can be reduced without an increase in frame frequency. The color breakup can be further reduced by combining the above structure with a driving method for shortening a writing period.

This embodiment can be implemented in appropriate combination with the structures described in the other embodiments.

Embodiment 2

Figure 6A:
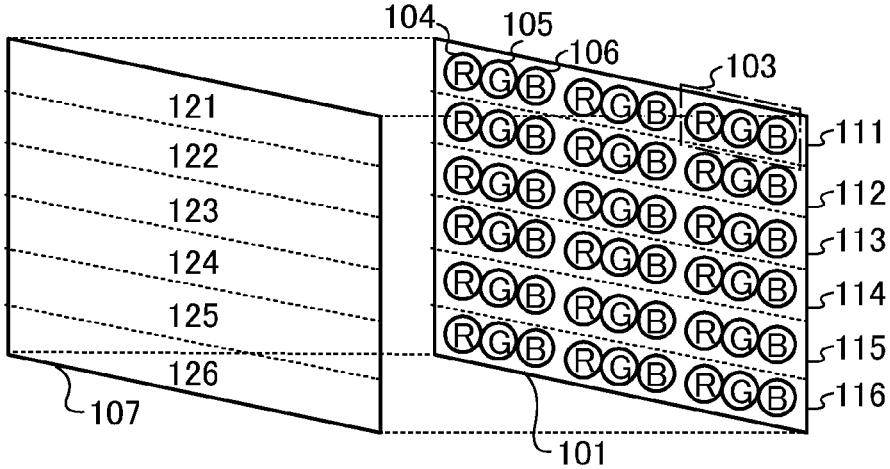
FIGS. 6A and 6B are schematic diagrams and FIG. 6C is a timing chart of one embodiment of the present invention.

In this embodiment, a structure different from that in Embodiment 1 in the numbers of light source regions and pixel regions which are obtained by division will be described. As in FIG. 1B, FIG. 6A is a schematic diagram of the backlight portion 101 and the display panel 102 for description. Note that in this embodiment, a detailed description of the structure corresponding to the structure in Embodiment 1 is omitted and the description of Embodiment 1 is referred to in some cases.

Specifically, as illustrated in FIG. 6A, the light source region is divided into a first region 111, a second region 112, a third region 113, a fourth region 114, a fifth region 115, and a sixth region 116. The first regions 111 to the sixth regions 116 each include a plurality of red (R) light sources 104, green (G) light sources 105, and blue (B) light sources 106. Three light sources each of a different color are combined in each backlight unit 103.

In the schematic diagram in FIG. 6A, the pixel portion 107 includes a first pixel region 121, a second pixel region 122, a third pixel region 123, a fourth pixel region 124, a fifth pixel region 125, and a sixth pixel region 126 which correspond to the first region 111, the second region 112, the third region 113, the fourth region 114, the fifth region 115, and the sixth region 116, respectively.

Figure 6B:
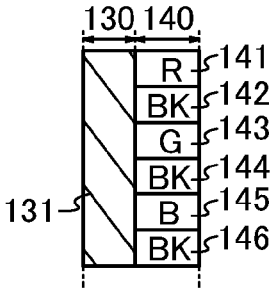

Next, a writing period in which video signals are written to the first pixel region 121 to the sixth pixel region 126 and light emission or non-light emission of the backlight units 103 in the first region 111 to the sixth region 116 are described. FIG. 6B is a schematic diagram of one subframe period for describing a timing chart of this embodiment.

FIG. 6B illustrates a writing period 130 and a light emission period 140. FIG. 6B illustrates a writing operation 131 to the each row and each column of the first pixel region 121 to the sixth pixel region 126, a light emission or non-light-emission operation 141 in the first region 111, a light emission or non-light-emission operation 142 in the second region 112, a light emission or non-light-emission operation 143 in the third region 113, a light emission or non-light-emission operation 144 in the fourth region 114, a light emission or non-light-emission operation 145 in the fifth region 115, and a light emission or non-light-emission operation 146 in the sixth region 116. Note that in FIG. 6B, after the writing operation 131 to the first pixel region 121 to the sixth pixel region 126 is completed, the operation 141 to the operation 146 are performed at the same time.

The writing operation 131 in FIG. 6B may be any operation as long as video signals corresponding to the operations 141 to 146 are written. For example, a structure in which a video signal is sequentially written to each row and each column of the pixel portion 107 may be employed, or a structure in which a video signal is selectively written to any of the first pixel region 121 to the sixth pixel region 126 which each correspond to a region where an operation of performing light emission of light sources of the backlight portion 101 is performed may be employed.

The operation 141 in FIG. 6B represents light emission using the red (R) light sources. In other words, in the operation 141, the red (R) light sources 104 of the backlight units 103 in the first region 111 emit lights. The operation 143 represents light emission using the green (G) light sources. In other words, in the operation 143, the green (G) light sources 105 of the backlight units 103 in the third region 113 emit lights. The operation 145 represents light emission using the blue (B) light sources. In other words, in the operation 145, the blue (B) light sources 106 of the backlight units 103 in the fifth region 115 emit lights.

The operation 142, the operation 144, and the operation 146 in FIG. 6B each represent non-light-emission of the RGB light sources, that is, black display (BK) is performed. In other words, in the operation 142, the operation 144, and the operation 146, the RGB light sources of the backlight units 103 in the second region 112, the fourth region 114, and the sixth region 116 emit no light all at once.

In a structure of this embodiment described below, light emission or non-light-emission periods in the operations 141 to 146 are described as subframe periods. As an example, in this embodiment, a first subframe period refers to a period in which light sources of the first region 111, the third region 113, and the fifth region 115 emit lights and light sources of the second region 112, the fourth region 114, and the sixth region 116 emit no light. A second subframe period refers to a period in which light sources of the first region 111, the third region 113, and the fifth region 115 emit no light and light sources of the second region 112, the fourth region 114, and the sixth region emit lights. Note that in practice, the period in which light sources of the first region 111 to the sixth region 116 emit lights is in a range the same as or narrower than the range of the first subframe period and the second subframe period.

Note that the driving method of a liquid crystal display device, which is described in this embodiment, can have a structure in which the writing period 130 and the light emission period 140 overlap with each other. In other words, in the driving method of a liquid crystal display device, which is described in this embodiment, a period needed only for writing a video signal can be hidden by overlapping with a period in which the light sources in the light emission period 140 emit no light. For example, in the period (BK) in which light sources of the second region 112, the fourth region 114, and the sixth region 116 of the first subframe periods emit no light and the period (BK) in which light sources of the first region 111, the third region 113, and the fifth region 115 of the second subframe periods emit no light, a video signal of a region in which a light source emits light in a subsequent period can be written; thus, a period needed only for writing a video signal can not be seen. Thus, the structure of this embodiment can be described without illustrating the writing operation of the writing period 130. In this case, video signals are written in a period just before the first subframe period, in which light sources of the first region 111 to the sixth region 116 emit no light.

Note that in the structure in which the writing period 130 and the light emission period 140 overlap with each other, it is preferable that the length of the light emission period 140 be set longer than the length of the period needed only for writing a video signal.

Figure 6C:
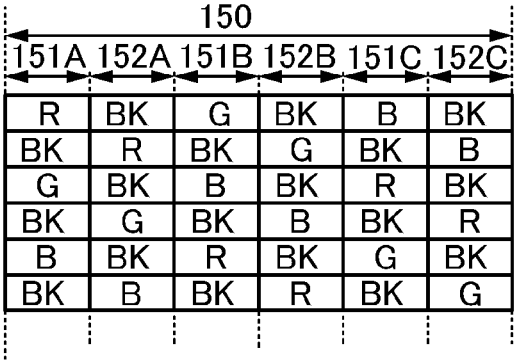

Next, FIG. 6C is a timing chart of a plurality of subframe periods included in one frame period. One frame period 150 in the timing chart in FIG. 6C can be roughly divided into a video signal writing period; a first subframe period 151A, a first subframe period 151B, and a first subframe period 151C; and a second subframe period 152A, a second subframe period 152B, and a second subframe period 152C. Note that video signals of the first subframe period 151A are written in a frame period just before the first subframe period 151A, in which RGB light sources of backlight units emit no light.

In the first subframe period 151A, the first subframe period 151B, and the first subframe period 151C in FIG. 6C, the light sources of the first region 111, the light sources of the third region 113, and the light sources of the fifth region 115 emit lights at the same time by the operation 141, the operation 143, and the operation 145, respectively. In addition, in the first subframe period 151A, the first subframe period 151B, and the first subframe period 151C in FIG. 6C, the light sources in the first region 111, the light sources in the third region 113, and the light sources in the fifth region 115 emit lights of different colors.

In the first subframe period 151A, the first subframe period 151B, and the first subframe period 151C in FIG. 6C, the light sources of the second region 112, the light sources of the fourth region 114, and the light sources of the sixth region 116 emit no light at the same time by the operation 142, the operation 144, and the operation 146, respectively.

In the second subframe period 152A, the second subframe period 152B, and the second subframe period 152C each of which is provided after the first subframe period in FIG. 6C, the light sources of the second region 112, the light sources of the fourth region 114, and the light sources of the sixth region 116 emit lights at the same time by the operation 142, the operation 144, and the operation 146, respectively. In addition, in the second subframe period 152A, the second subframe period 152B, and the second subframe period 152C in FIG. 6C, the light sources in the second region 112, the light sources in the fourth region 114, and the light sources in the sixth region 116 emit lights of different colors.

In the second subframe period 152A, the second subframe period 152B, and the second subframe period 152C each of which is provided after the first subframe period in FIG. 6C, the light sources of the first region 111, the light sources of the third region 113, and the light sources of the fifth region emit no light at the same time by the operation 141, the operation 143, and the operation 145, respectively.

As in FIG. 1D, the driving method of this embodiment has a structure in which light emission of different colors is performed in regions where light sources emit lights at the same time in the first subframe periods and the second subframe periods; and the regions where the light sources emit lights at the same time are separated from each other, with a region where light sources emit no light at the same time interposed therebetween. Therefore, color mixture in a boundary portion of light sources can be suppressed and display quality can be improved in a liquid crystal display device where display is performed by a field sequential method when light sources of the backlight portion are divided into a plurality of regions and lights of a plurality of colors are emitted.

In the driving method of this embodiment, the light sources of the backlight portion in the subframe periods do not have single colors but have a plurality of colors in a plurality of regions. Particularly in the structure of this embodiment, three colors of RGB for color display are expressed in a plurality of regions by the light sources of a plurality of colors in the plurality of regions. Therefore, lacking only data of any of the colors of light sources of a plurality of colors for color display, which is caused by blink of a user, and the like, is less likely to occur; thus, color breakup can be reduced without an increase in frame frequency.

Note that the block diagram for illustrating driving of the liquid crystal display device, which is described in this embodiment, is similar to the block diagram in FIG. 3, which is described in the above embodiment.

Figure 7:
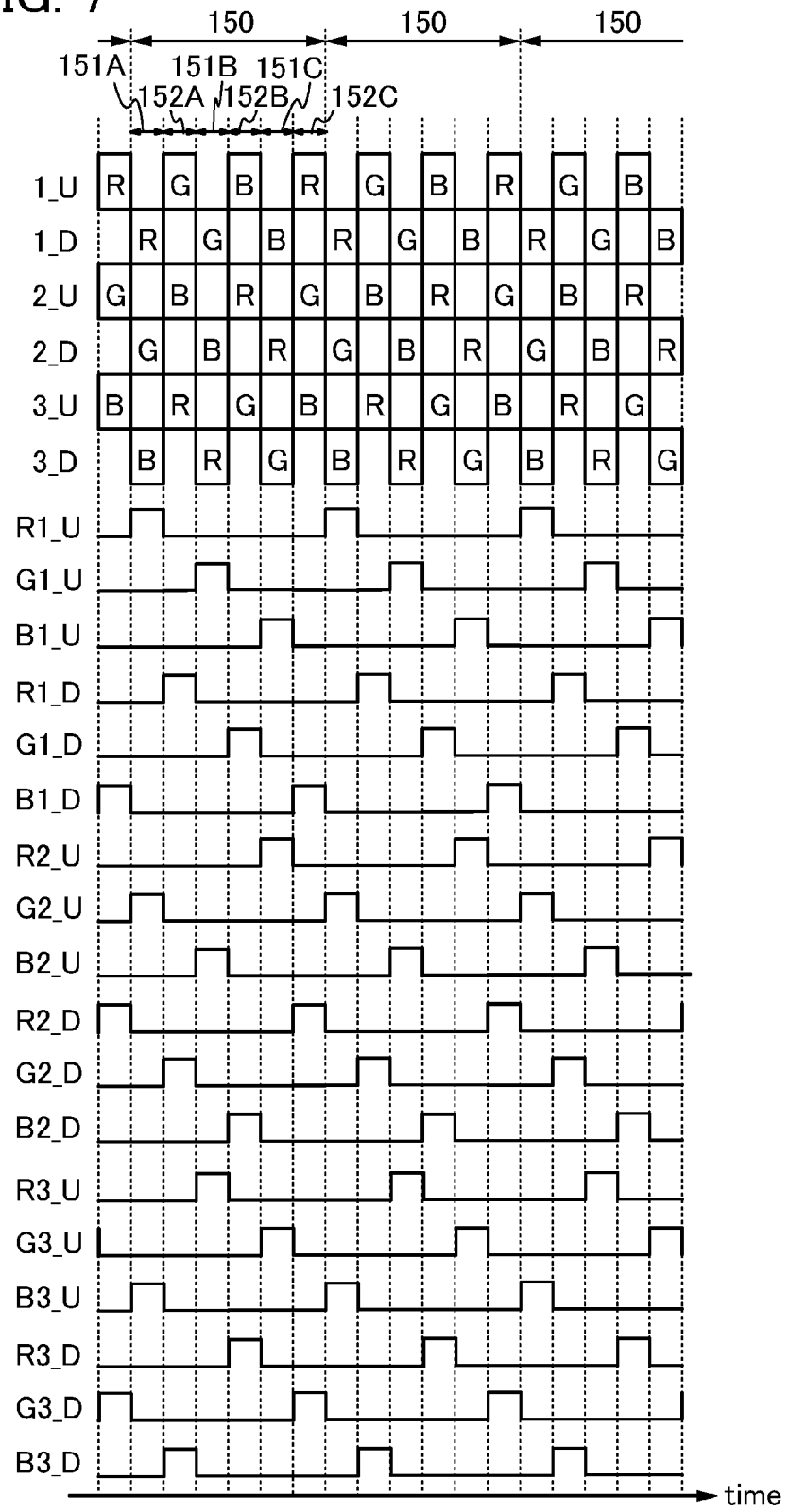
FIG. 7 is a timing chart of one embodiment of the present invention.

Next, FIG. 7 shows an example of detailed waveforms of the timing chart in FIG. 6C. Note that in the timing chart in FIG. 7, the length of a writing period is made half by sequentially performing light emission of light sources in a pixel region where video signals are written and writing at the same time the video signals of the first pixel region, the third pixel region, and the fifth pixel region and the video signals of the second pixel region, the fourth pixel region, and the sixth pixel region.

In the timing chart in FIG. 7, the fifth pixel region 125, the sixth pixel region 126, the fifth region 115, the sixth region 116, the operation 145, and the operation 146 are added to "1_U", "1_D", "2_U", and "2_D"; and "R1_U", "G1_U", "B1_U", "R1_D", "G1_D", "B1_D", "R2_U", "G2_U", "B2_U", "R2_D", "G2_D", and "B2_D" which are shown in the timing chart in FIG. 2.

In the timing chart in FIG. 7, writing of video signals to the fifth pixel region 125 is denoted by "3_U". In the timing chart in FIG. 7, writing of video signals to the sixth pixel region 126 is denoted by "3_D".

In the timing chart in FIG. 7, red (R) light sources 104 of the backlight units in the fifth region 115 emit lights at a potential of a high level and emit no light at a potential of a low level (R3_U). In the timing chart in FIG. 7, green (G) light sources 105 of the backlight units in the fifth region 115 emit lights at a potential of a high level and emit no light at a potential of a low level (G3_U). In the timing chart in FIG. 7, blue (B) light sources 106 of the backlight units in the fifth region 115 emit lights at a potential of a high level and emit no light at a potential of a low level (B3_U).

In the timing chart in FIG. 7, red (R) light sources 104 of the backlight units in the sixth region 116 emit lights at a potential of a high level and emit no light at a potential of a low level (R3_D). In the timing chart in FIG. 7, green (G) light sources 105 of the backlight units in the sixth region 116 emit lights at a potential of a high level and emit no light at a potential of a low level (G3_D). In the timing chart in FIG. 7, blue (B) light sources 106 of the backlight units in the sixth region 116 emit lights at a potential of a high level and emit no light at a potential of a low level (B3_D).

Next, the operation of the first subframe period 151A in the above described timing chart of FIG. 7 is specifically described. Note that in a frame period just before the first subframe period 151A, an R video signal is written in 1_U, a G video signal is written in 2_U, and a B video signal is written in 3_U.

In the first subframe period 151A, R1_U, G2_U, and B3_U are changed from a low level to a high level, and the red (R) light sources 104 of the backlight units in the first region 111, the green (G) light sources 105 of the backlight units in the third region 113, and the blue (B) light sources 106 of the backlight units in the fifth region 115 emit lights. At this time, video signals are written to the second pixel region 122, the fourth pixel region 124, and the sixth pixel region 126 corresponding to the second region 112, the fourth region 114, and the sixth region 116, respectively, the light sources of which emit lights in the second subframe period 152A which is a subsequent subframe period. In other words, an R video signal is written in 1_D, a G video signal is written in 2_D, and a B video signal is written in 3_D. Operations of other subframe periods may be performed as illustrated in FIG. 7.

Figure 8:
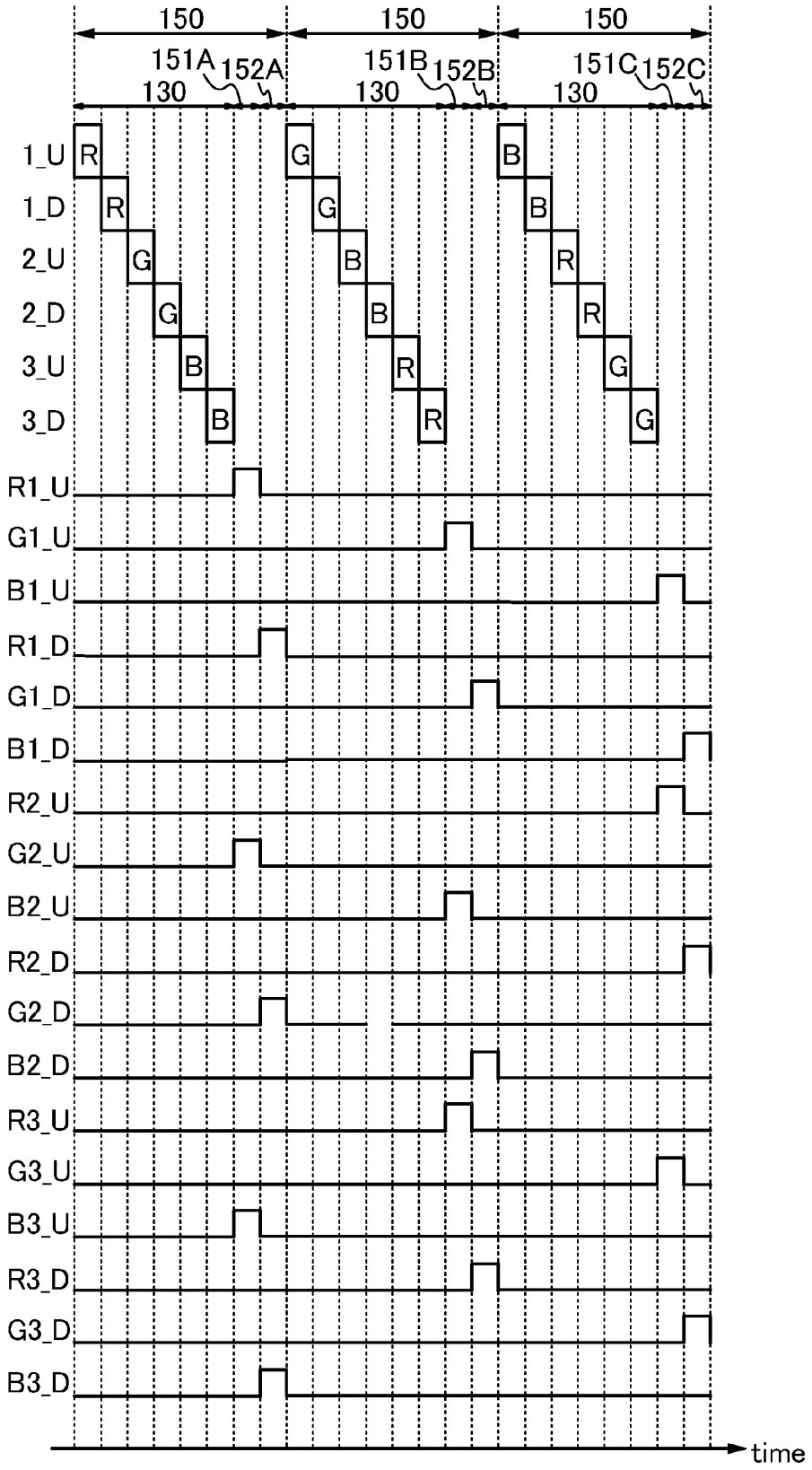
FIG. 8 is a timing chart of one embodiment of the present invention.

Next, FIG. 8 is a timing chart different from the timing chart of FIG. 7. Note that the timing chart in FIG. 8 differs from the timing chart in FIG. 7 in that a first subframe period and a second subframe period to be a light emission period 140 are provided after a writing period 130 where a video signal is written to each row and each column of the pixel portion. In other words, by providing the first subframe period and the second subframe period apart from the writing period, a structure of a driver circuit which is needed to write video signals can be simplified without having a complicated structure in which, for example, video signals of different pixel regions are written at the same time.

In the timing chart in FIG. 8 as in the timing chart in FIG. 7, "1_U", "1_D", "2_U", "2_D", "3_U", and "3_D" express writing of video signals, and "R1_U", "G1_U", "B1_U", "R1_D", "G1_D", "B1_D", "R2_U", "G2_U", "B2_U", "R2_D", "G2_D", "B2_D", "R3_U", "G3_U", "B3_U", "R3_D", "G3_D", and "B3_D" express light emission of light sources.

Specific operations of the timing chart in FIG. 8 are described herein. First, in the writing period 130, an R video signal is written in 1_U, an R video signal is written in 1_D, a G video signal is written in 2_U, a G video signal is written in 2_D, a B video signal is written in 3_U, and then a B video signal is written in 3_D. In the first subframe period 151A, R1_U, G2_U, and B3_U are changed from a low level to a high level, and the red (R) light sources 104 of the backlight units in the first region 111, the green (G) light sources 105 of the backlight units in the third region 113, and the blue (B) light sources 106 of the backlight units in the fifth region 115 emit lights. In the second subframe period 152A, R1_D, G2_D, and B3_D are changed from a low level to a high level, and the red (R) light sources 104 of the backlight units in the second region 112, the green (G) light sources 105 of the backlight units in the fourth region 114, and the blue (B) light sources 106 of the backlight units in the sixth region 116 emit lights. Operations of other subframe periods may be performed as illustrated in FIG. 8.

Figure 9:
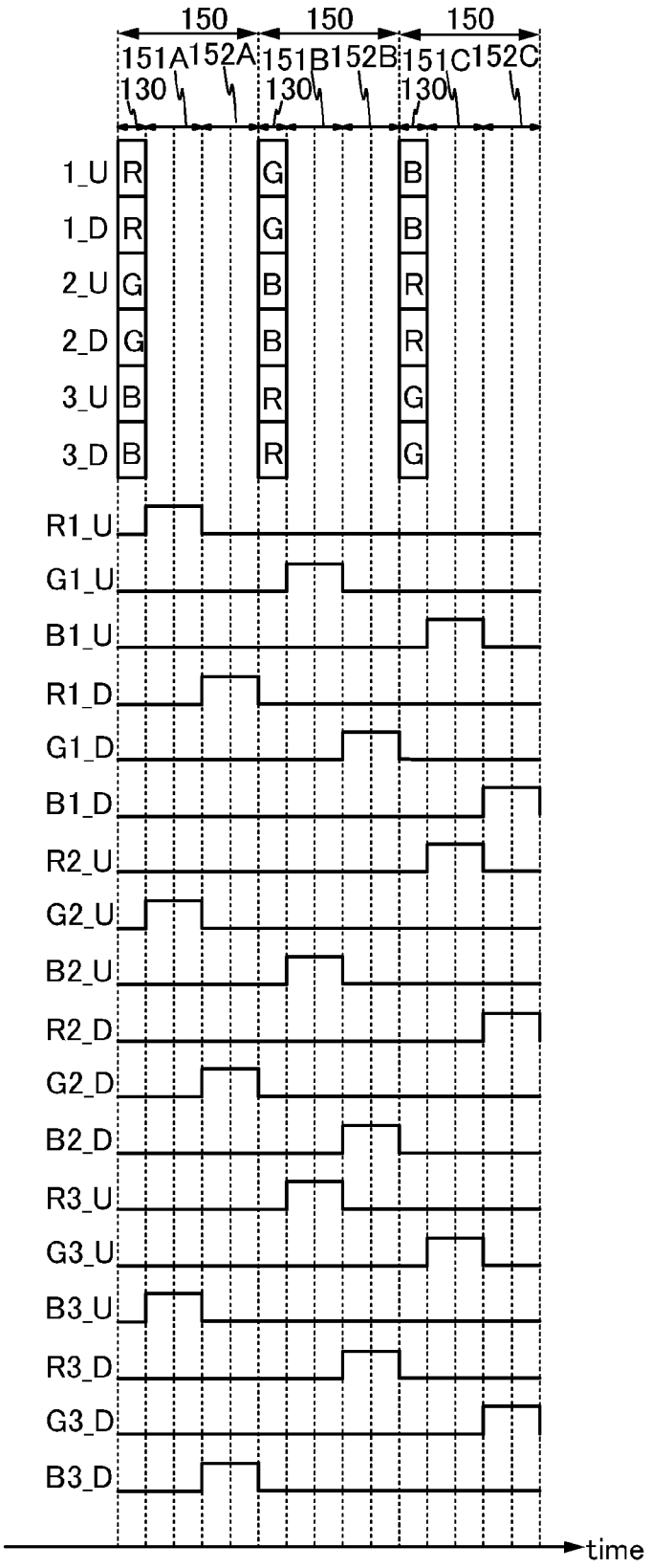
FIG. 9 is a timing chart of one embodiment of the present invention.

Next, FIG. 9 is a timing chart different from the timing charts of FIG. 7 and FIG. 8. Note that in the timing chart in FIG. 9, a writing period is made much shorter and instead a light emission period is made longer by writing at the same time video signals of divided pixel regions. In other words, one frame period can be shortened because a first subframe period and a second subframe period can be shortened; therefore, it can be expected that color breakup due to an increase in frame frequency be reduced. Moreover, it can be expected that luminance be improved by lengthening a light emission period.

In the timing chart in FIG. 9 as in the timing chart in FIG. 7 and FIG. 8, "1_U", "1_D", "2_U", "2_D", "3_U", and "3_D" express writing of video signals, and "R1_U", "G1_U", "B1_U", "R1_D", "G1_D", "B1_D", "R2_U", "G2_U", "B2_U", "R2_D", "G2_D", "B2_D", "R3_U", "G3_U", "B3_U", "R3_D", "G3_D", and "B3_D" express light emission of light sources.

Specific operations of the timing chart in FIG. 9 are described herein. First, in a writing period 130, an R video signal is written in 1_U, an R video signal is written in 1_D, a G video signal is written in 2_U, a G video signal is written in 2_D, a B video signal is written in 3_U, and a B video signal is written in 3_D. These writings are performed at the same time. In the first subframe period 151A, R1_U, G2_U, and B3_U are changed from a low level to a high level, and the red (R) light sources 104 of the backlight units in the first region 111, the green (G) light sources 105 of the backlight units in the third region 113, and the blue (B) light sources 106 of the backlight units in the fifth region 115 emit lights. In the second subframe period 152A, R1_D, G2_D, and B3_D are changed from a low level to a high level, and the red (R) light sources 104 of the backlight units in the second region 112, the green (G) light sources 105 of the backlight units in the fourth region 114, and the blue (B) light sources 106 of the backlight units in the sixth region 116 emit lights. Operations of other subframe periods may be performed as illustrated in FIG. 9.

As described above, the driving method of this embodiment has a structure in which light emission of different colors is performed in regions where light sources emit lights at the same time in the first subframe periods and the second subframe periods; and the regions where the light sources emit lights at the same time are separated from each other, with a region where light sources emit no light at the same time interposed therebetween. Therefore, color mixture in a boundary portion of light sources can be suppressed and display quality can be improved in a liquid crystal display device where display is performed by a field sequential method when light sources of the backlight portion are divided into a plurality of regions and lights of a plurality of colors are emitted.

In the driving method of this embodiment, the light sources of the backlight portion in the subframe periods do not have single colors but have a plurality of colors in a plurality of regions. Particularly in the structure of this embodiment, three colors of RGB for color display are expressed in a plurality of regions as the light sources of a plurality of colors in the plurality of regions. Therefore, lacking only data of any of the colors of light sources of a plurality of colors for color display, which is caused by blink of a user, is less likely to occur; thus, color breakup can be reduced without an increase in frame frequency. The color breakup can be further reduced by combining the above structure with a driving method for shortening a writing period.

This embodiment can be implemented in appropriate combination with the structures described in the other embodiments.

Embodiment 3

In this embodiment, the driving methods of a liquid crystal display device, which are described in the above embodiments, which includes a subframe period different from the subframe periods in which the RGB light sources emit lights, will be described. Note that in this embodiment, in some cases, detailed descriptions of the structure corresponding to the structures in Embodiments 1 and 2 are omitted and the descriptions of Embodiments 1 and 2 are referred to.

Figure 10A:
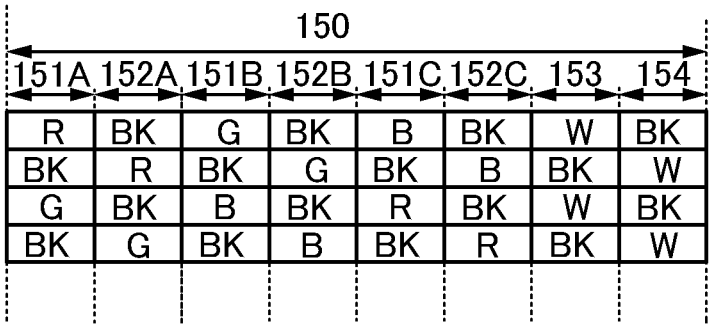
FIGS. 10A and 10B are timing charts of one embodiment of the present invention.

First, in FIG. 10A, a third subframe period and a fourth subframe period are included in addition to the first subframe period and the second subframe period of the one-frame period which are described above in Embodiment 1.

A third subframe period 153 and a fourth subframe period 154 in FIG. 10A are provided so as to follow the first subframe period 151A, the first subframe period 151B, and the first subframe period 151C and the second subframe period 152A, the second subframe period 152B, and the second subframe period 152C in Embodiment 1.

In the third subframe period 153 in FIG. 10A, the light sources of the first region 111 and the light sources of the third region 113 emit lights at the same time by the operation 141 and the operation 143, respectively. Further, in the third subframe period 153 in FIG. 10A, colors of the light sources of the first region 111 and the light sources of the third region 113 are expressed by emitting white (W) light sources.

Note that for the white (W) light source, a structure in which light sources whose colors are complementary to each other are combined emit lights at the same time or a structure in which RGB light sources emit lights at the same time may be employed besides a structure in which a white light source, such as a light-emitting diode which emits white light, may be provided.

Moreover, in the third subframe period 153 in FIG. 10A, the light sources of the second region 112 and the light sources of the fourth region 114 emit no light at the same time by the operation 142 and the operation 144, respectively.

In the fourth subframe period 154 in FIG. 10A, the light sources of the second region 112 and the light sources of the fourth region 114 emit lights at the same time by the operation 142 and the operation 144, respectively. Further, in the fourth subframe period 154 in FIG. 10A, as the respective colors of the light sources of the second region 112 and the light sources of the fourth region 114, white (W) light sources emit lights.

In the fourth subframe period 154 in FIG. 10A, the light sources of the first region 111 and the light sources of the third region 113 emit no light at the same time by the operation 141 and the operation 143, respectively.

Figure 10B:
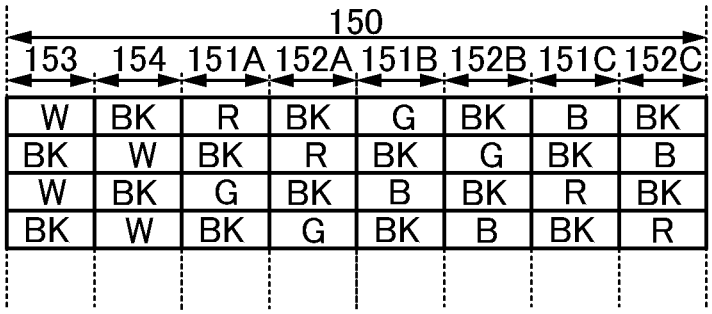

Although the third subframe period 153 and the fourth subframe period 154 in FIG. 10A are provided so as to follow the first subframe period 151A, the first subframe period 151B, and the first subframe period 151C and the second subframe period 152A, the second subframe period 152B, and the second subframe period 152C, another structure may be employed. For example, as illustrated in FIG. 10B, the third subframe period 153 and the fourth subframe period 154 may be provided before the first subframe period 151A, the first subframe period 151B, and the first subframe period 151C and the second subframe period 152A, the second subframe period 152B, and the second subframe period 152C.

First, in FIG. 11A, a third subframe period and a fourth subframe period are included in addition to the first subframe period and the second subframe period of the one-frame period which are described above in Embodiment 2.

A third subframe period 153 and a fourth subframe period 154 in FIG. 11A are provide, so as to follow the first subframe period 151A, the first subframe period 151B, and the first subframe period 151C and the second subframe period 152A, the second subframe period 152B, and the second subframe period 152C in Embodiment 2.

In the third subframe period 153 in FIG. 11A, the light sources of the first region 111, the light sources of the third region 113, and the light sources of the fifth region 115 emit lights at the same time by the operation 141, the operation 143, and the operation 145, respectively. Further, in the third subframe period 153 in FIG. 11A, as the light sources of the first region 111, the light sources of the third region 113, and the light sources of the fifth region 115, white (W) light sources emit lights.

In the third subframe period 153 in FIG. 11A, the light sources of the second region 112, the light sources of the fourth region 114, and the light sources of the sixth region 116 emit no light at the same time by the operation 142, the operation 144, and the operation 146, respectively.

In the fourth subframe period 154 in FIG. 11A, the light sources of the second region 112, the light sources of the fourth region 114, and the light sources of the sixth region 116 emit lights at the same time by the operation 142, the operation 144, and the operation 146, respectively. Further, in the fourth subframe period 154 in FIG. 12A, as the light sources of the second region 112, the light sources of the fourth region 114, and the light sources of the sixth region 116, white (W) light sources emit lights.

In the fourth subframe period 154 in FIG. 11A, the light sources of the first region 111, the light sources of the third region 113, and the light sources of the fifth region 115 emit no light at the same time by the operation 141, the operation 143, and the operation 145, respectively.

Although the third subframe period 153 and the fourth subframe period 154 in FIG. 11A are provided so as to follow the first subframe period 151A, the first subframe period 151B, and the first subframe period 151C and the second subframe period 152A, the second subframe period 152B, and the second subframe period 152C, another structure may be employed. For example, as illustrated in FIG. 11B, the third subframe period 153 and the fourth subframe period 154 may be provided before the first subframe period 151A, the first subframe period 151B, and the first subframe period 151C and the second subframe period 152A, the second subframe period 152B, and the second subframe period 152C.

As described in the above description of FIGS. 10A and 10B and FIGS. 11A and 11B, the driving method of this embodiment has a structure in which light emission of different colors is performed in regions where light sources emit lights at the same time in the first subframe periods and the second subframe periods; and the regions where the light sources emit lights at the same time are separated from each other, with a region where light sources emit no light at the same time interposed therebetween. Therefore, color mixture in a boundary portion of light sources can be suppressed and display quality can be improved in a liquid crystal display device where display is performed by a field sequential method when light sources of the backlight portion are divided into a plurality of regions and lights of a plurality of colors emit lights.

In the driving method of this embodiment, the light sources of the backlight portion in the subframe periods do not have single colors but have a plurality of colors in a plurality of regions. Therefore, lacking only data of any of the colors of light sources of a plurality of colors for color display, which is caused by blink of a user, is less likely to occur; thus, color breakup can be reduced without an increase in frame frequency.

Moreover, in the driving method of this embodiment, with a structure in which a period in which a white light source emits light is provided in each frame period, a degradation in luminance of display images in the case where a non-light-emission period is provided can be suppressed and power consumption can be reduced.

Note that the third subframe period and the fourth subframe period in which white light sources emit lights are preferably provided when all pixels display a white image or all pixels display a monochrome image. Further, the third subframe period and the fourth subframe period in which white light sources emit lights may be provided in the case where the frequency of writing of a white video signal for expressing white to the pixel portion is high, without limitation to the case where a white image or a monochrome image is displayed.

Note that the third subframe period and the fourth subframe period in which white light sources emit lights are preferably provided when some of pixles (e.g. pixels in any one of the first pixel region 121 to the fourth pixel region 124 in the structure of FIG. 1A) display a white image or a monochrome image. Further, the third subframe period and the fourth subframe period in which white light sources emit lights may be provided in the case where the frequency of writing of a white video signal for expressing white to the pixel portion is high.

As another structure, the third subframe period and the fourth subframe period in which white light sources emit lights may be provided when an image to be displayed includes a white component. For example, as long as a video signal is for displaying a color image including a white component, first, a base video signal is separated into a white component video signal and an RGB component video signal. With the RGB component video signal, field sequential driving is performed in the first subframe period and the second subframe period. Then, with the white component video signal, white is expressed in the third subframe period and the fourth subframe period.

When a white image is displayed in the structure in which the display is performed by separating a video signal into a white component video signal and an RGB component video signal, the video signal is preferably separated so that the luminance of the white component video signal is higher than the luminance of the RGB component video signal, instead of being the same as the luminance of the RGB component video signal. With this structure, recognition of color breakup can be suppressed.

The above video signal used when the third subframe period and the fourth subframe period in which white light sources emit lights are provided may be generated by the video signal processing circuit 512 in FIG. 3 described above in Embodiment 1. Specifically, whether a video signal includes a white component may be judged by calculating a histogram of the video signal for each color component.

Note that although, in FIGS. 10A and 10B and FIGS. 11A and 11B, a structure is described in which, as subframe periods different from the subframe periods in which the RGB light sources emit lights, the subframe periods in which white light sources emit lights is described, a structure having another subframe period may be employed. For example, as illustrated in FIG. 12A, as a subframe period which is combined with the structure of Embodiment 1, a subframe period 155 (also referred to as a fifth subframe period) in which all of the light sources emit no light may be included. Alternatively, as illustrated in FIG. 12B, as a subframe period which is combined with the structure of Embodiment 2, the subframe period 155 in which all of the light sources emit no light may be included.

Besides, as illustrated in FIG. 12C, as a subframe period which is combined with the structure of FIG. 10A, the subframe period 155 in which all of the light sources emit no light may be included. Alternatively, as illustrated in FIG. 12D, as a subframe period which is combined with the structure of FIG. 11A, the subframe period 155 in which all of the light sources emit no light may be included.

With any of the above structures, color breakup can be reduced without an increase in frame frequency in a liquid crystal display device where display is performed by a field sequential method.

According to one embodiment of the present invention, color mixture in a boundary portion of light sources can be suppressed and display quality can be improved in a liquid crystal display device where display is performed by a field sequential method when light sources are divided into a plurality of regions and lights of a plurality of colors are emitted.

According to another embodiment of the present invention, when a non-light-emission period is provided in a liquid crystal display device where display is performed by a field sequential method, a degradation in luminance of display images can be suppressed and power consumption can be reduced.

This embodiment can be implemented in appropriate combination with the structures described in the other embodiments.

Embodiment 4

In this embodiment, a structure example of a liquid crystal display device for realizing the field sequential driving method described in the above embodiment, in which pixels of each row are selected and driven at the same time, will be shown.

Figure 14A:
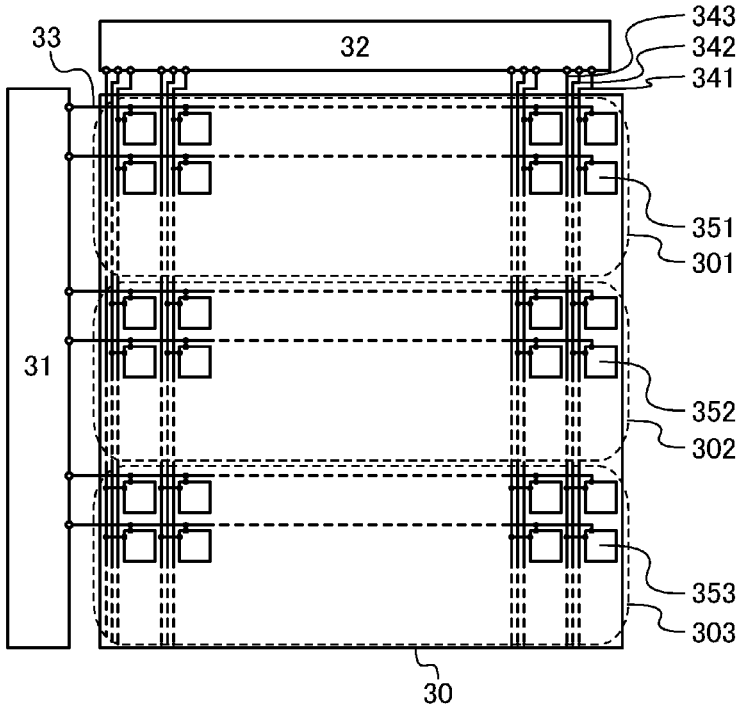
FIG. 14A is a block diagram and FIGS. 14B to 14D are each a circuit diagram of one embodiment of the present invention.

FIG. 14A is a diagram illustrating a structure example of a liquid crystal display device. The liquid crystal display device in FIG. 14A includes a pixel portion 30; a scan line driver circuit 31; a data line driver circuit (also referred to as a signal line driver circuit) 32; 3n (n is a natural number of 2 or larger) scan lines 33 which are arranged parallel or substantially parallel to each other and whose potentials are controlled by the scan line driver circuit 31; and m (m is a natural number of 2 or larger) first data lines 341, m second data lines 342, and m third data lines 343 which are arranged parallel or substantially parallel to each other and whose potentials are controlled by the data line driver circuit 32.

The pixel portion 30 is divided into three regions (regions 301 to 303) and includes a plurality of pixels which are arranged in matrix (n rows by m columns) in each region. Each of the scan lines 33 is connected to m pixels arranged in a given row among the plurality of pixels arranged in matrix (3n rows and m columns) in the pixel portion 30. In addition, each of the first data lines 341 is connected to n pixels arranged in a given column among a plurality of pixels 351 arranged in matrix (n rows by m columns) in the region 301. Further, each of the second data lines 342 is connected to n pixels arranged in a given column among a plurality of pixels 352 arranged in matrix (n rows by m columns) in the region 302. Furthermore, each of the third data lines 343 is connected to n pixels arranged in a given column among a plurality of pixels 353 arranged in matrix (n rows by m columns) in the region 303.

Note that a start pulse signal (GSP) for the scan line driver circuit, a clock signal (GCK) for the scan line driver circuit, and drive power supply potentials such as a high power supply potential and a low power supply potential are input to the scan line driver circuit 31 from the outside. Further, signals such as a start signal (SSP) for the data line driver circuit, the clock signal (SCK) for the data line driver circuit, and video signals (data1 to data3), and drive power supply potentials such as a high power supply potential and a low power supply potential are input to the data line driver circuit 32 from the outside.

Figure 14B:
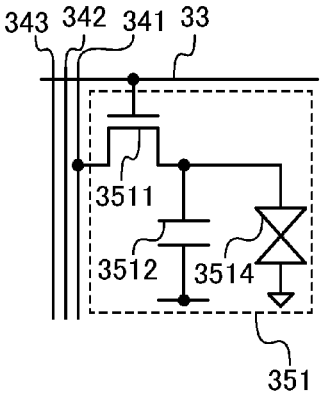
Figure 14C:
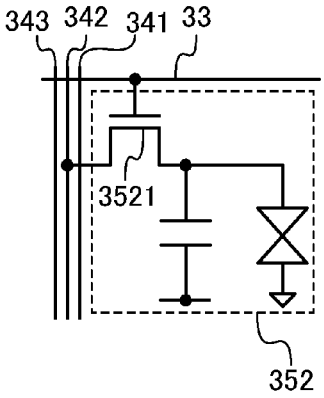
Figure 14D:
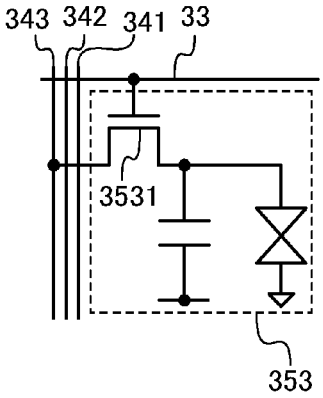

FIGS. 14B to 14D each show an example of a circuit configuration of a pixel. Specifically, FIG. 14B shows an example of the circuit configuration of the pixel 351 provided in the region 301; FIG. 14C shows an example of the circuit configuration of the pixel 352 provided in the region 302; and FIG. 14D shows an example of the circuit configuration of the pixel 353 provided in the region 303. The pixel 351 in FIG. 14B includes a transistor 3511, a capacitor 3512, and a liquid crystal element 3514. A gate terminal of the transistor 3511 is electrically connected to the scan line 33. One terminal of a source and a drain of the transistor 3511 is connected to the first data line 341. One electrode of the capacitor 3512 is connected to the other terminal of the source and drain of the transistor 3511. The other electrode of the capacitor 3512 is connected to a capacitor line. One electrode (a pixel electrode) of the liquid crystal element 3514 is connected to the other terminal of the source and the drain of the transistor 3511 and one electrode of the capacitor 3512. The other electrode (a counter electrode) of the liquid crystal element 3514 is connected to a wiring for supplying a counter potential.

The circuit configurations of the pixel 352 in FIG. 14C and the pixel 353 in FIG. 14D are the same as that of the pixel 351 in FIG. 14B. Note that the pixel 352 in FIG. 14C differs from the pixel 351 in FIG. 14B in that one of a source and a drain of a transistor 3521 is connected to the second data line 342 instead of the first data line 341; and the pixel 353 in FIG. 14D differs from the pixel 351 in FIG. 14B in that one of a source and a drain of a transistor 3531 is connected to the third data line 343 instead of the first data line 341.

Figure 15A:
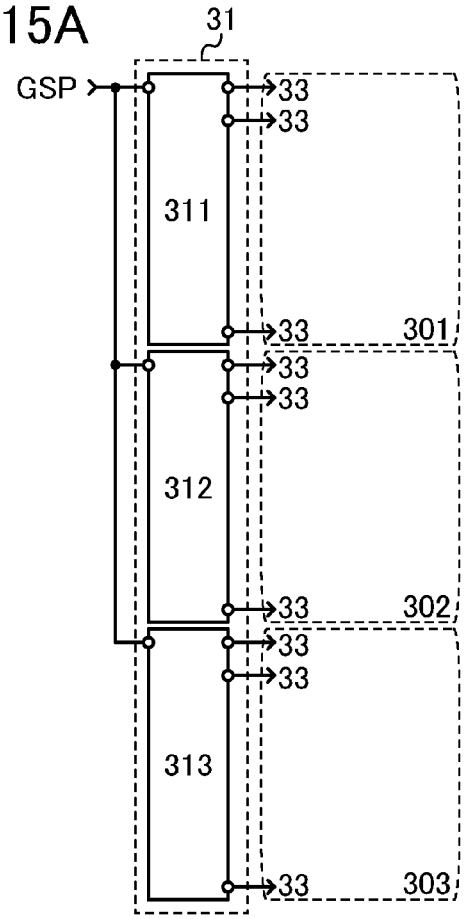
FIG. 15A is a block diagram and FIG. 15B is a timing chart of one embodiment of the present invention.

FIG. 15A shows a structure example of the scan line driver circuit 31 included in the liquid crystal display device in FIG. 14A. The scan line driver circuit 31 in FIG. 15A includes shift registers 311 to 313 each including n output terminals. Note that output terminals of the shift register 311 are connected to the respective n scan lines 33 provided in the region 301. Output terminals of the shift register 312 are connected to the respective n scan lines 33 provided in the region 302. Output terminals of the shift register 313 are connected to the respective n scan lines 33 provided in the region 303. In other words, the shift register 311 scans scan signals to the region 301; the shift register 312 scans scan signals to the region 302; and the shift register 313 scans scan signals to the region 303. Specifically, the shift register 311 has a function of sequentially shifting scan signals (sequentially selecting the scan lines 33 every half the cycle of the clock signal (GCK) for the scan line driver circuit) from the scan line 33 in a first row in response to the start pulse signal (GSP) for the scan line driver circuit that is input from the outside; the shift register 312 has a function of sequentially shifting scan signals from the scan line 33 in a (n+1)th row in response to the start pulse signal (GSP) for the scan line driver circuit that is input from the outside; and the shift register 313 has a function of sequentially shifting scan signals from the scan line 33 in a (2n+1)th row in response to the start pulse signal (GSP) for the scan line driver circuit that is input from the outside.

Figure 15B:
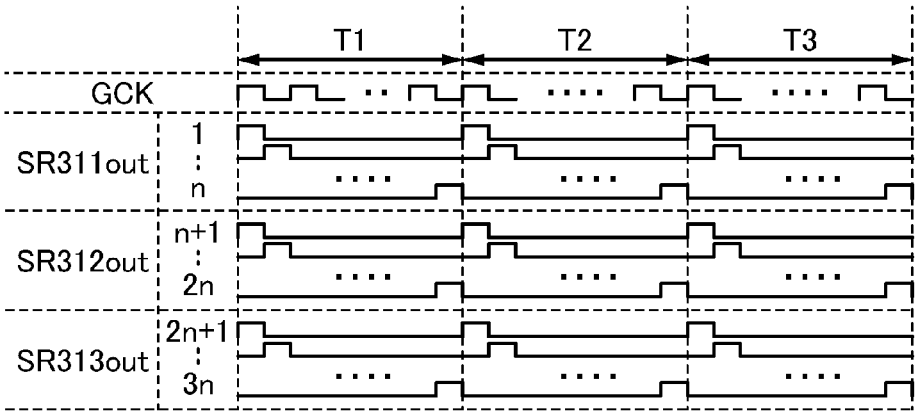

An operation example of the scan line driver circuit 31 in FIG. 15A is described with reference to FIG. 15B. Note that FIG. 15B illustrates the clock signal (GCK) for the scan line driver circuit, signals (SR311out) output from the n output terminals included in the shift register 311, signals (SR312out) output from the n output terminals included in the shift register 312, and signals (SR313out) output from the n output terminals included in the shift register 313.

In a subframe period (T1), high-level potentials are sequentially shifted from the scan line 33 provided in the first row to the scan line 33 provided in an n-th row every half the cycle of the clock signal (horizontal scan period) in the shift register 311; high-level potentials are sequentially shifted from the scan line 33 provided in the (n+1)th row to the scan line 33 provided in a 2n-th row every half the cycle of the clock signal (horizontal scan period) in the shift register 312; and high-level potentials are sequentially shifted from the scan line 33 provided in the (2n+1)th row to the scan line 33 provided in a 3n-th row every half the cycle of the clock signal (horizontal scan period) in the shift register 313. Therefore, in the scan line driver circuit 31, m pixels 351 provided in the first row to m pixels 351 provided in the n-th row are sequentially selected through the scan lines 33; m pixels 352 provided in the (n+1)th row to m pixels 352 provided in the 2n-th row are sequentially selected; and m pixels 353 provided in the (2n+1)th row to m pixels 353 provided in the 3n-th row are sequentially selected. In other words, in the scan line driver circuit 31, scan signals can be supplied to 3m pixels provided in different three rows every horizontal scan period.

In a subframe period (T2) and a subframe period (T3), the operation of the shift registers 311 to 313 is the same as that in the subframe period (T1). In other words, in the scan line driver circuit 31 as in the subframe period (T1), scan signals can be supplied to 3m pixels provided in given three rows every horizontal scan period.

In the display panel described above with reference to FIGS. 14A and 14B and FIGS. 15A and 15B, video signals can be supplied at the same time to pixels provided in a plurality of rows among pixels arranged in matrix. Thus, the input frequency of video signals to each pixel can be increased. Specifically, in the structure of the above liquid crystal display device, the input frequency of video signals to each pixel can be triple without any change in the clock frequency or the like of the scan line driver circuit. Accordingly, color breakup recognized in an image displayed by a field sequential method can be reduced.

This embodiment can be implemented in appropriate combination with the structures described in the other embodiments.

Embodiment 5

In this embodiment, an example of a transistor that can be applied to the liquid crystal display device disclosed in this specification will be described. There is no particular limitation on a structure of the transistor that can be applied to the liquid crystal display device disclosed in this specification. For example, a staggered transistor, a planar transistor, or the like having a top-gate structure in which a gate electrode is provided on the upper side of a semiconductor layer with a gate insulating layer interposed therebetween or a bottom-gate structure in which a gate electrode is provided on a lower side of a semiconductor layer with a gate insulating layer interposed therebetween can be used. Further, the transistor may have a single gate structure including one channel formation region, a double gate structure including two channel formation regions, or a triple gate structure including three channel formation regions. Alternatively, the transistor may have a dual gate structure including two gate electrode layers provided over and below a channel region with a gate insulating layer interposed therebetween. FIGS. 16A to 16D show examples of a cross-sectional structure of the transistor.

Figure 16A:
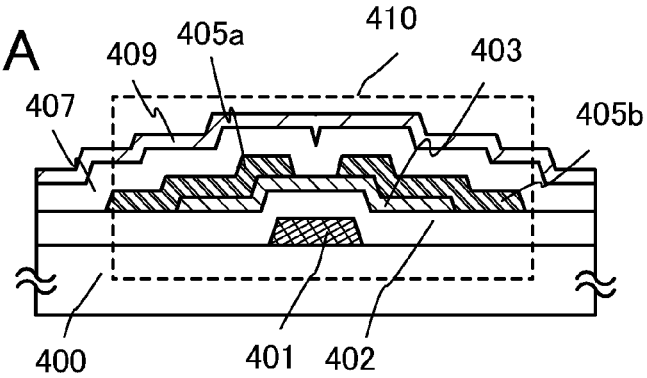
FIGS. 16A to 16D are cross-sectional views of one embodiment of the present invention.

A transistor 410 in FIG. 16A is one of bottom-gate transistors and is also referred to as an inverted staggered transistor.

The transistor 410 includes, over a substrate 400 having an insulating surface, a gate electrode layer 401, a gate insulating layer 402, a semiconductor layer 403, a source electrode layer 405*a*, and a drain electrode layer 405*b*. In addition, an insulating film 407 which covers the transistor 410 and is stacked over the semiconductor layer 403 is provided. Further, a protective insulating layer 409 is formed over the insulating film 407.

Figure 16B:
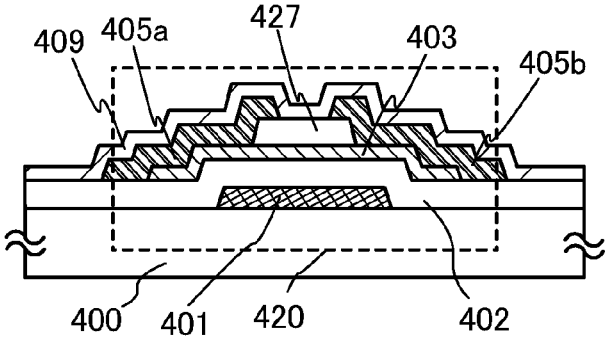

A transistor 420 in FIG. 16B is one of bottom-gate transistors referred to as a channel-protective type (also referred to as a channel-stop type) and is also referred to as an inverted staggered transistor.

The transistor 420 includes, over the substrate 400 having an insulating surface, the gate electrode layer 401, the gate insulating layer 402, the semiconductor layer 403, an insulating layer 427 which functions as a channel protective layer covering a channel formation region of the semiconductor layer 403, the source electrode layer 405*a*, and the drain electrode layer 405*b*. Further, the protective insulating layer 409 is formed to cover the transistor 420.

Figure 16C:
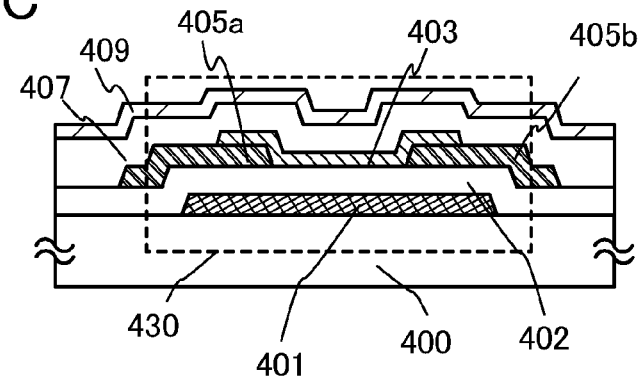

A transistor 430 in FIG. 16C, which is a bottom-gate transistor, includes, over the substrate 400 having an insulating surface, the gate electrode layer 401, the gate insulating layer 402, the source electrode layer 405*a*, the drain electrode layer 405*b*, and the semiconductor layer 403. The insulating film 407 which covers the transistor 430 and is in contact with the semiconductor layer 403 is provided. Further, the protective insulating layer 409 is formed over the insulating film 407.

In the transistor 430, the gate insulating layer 402 is provided over and in contact with the substrate 400 and the gate electrode layer 401; and the source electrode layer 405*a* and the drain electrode layer 405*b* are provided over and in contact with the gate insulating layer 402. Further, the semiconductor layer 403 is provided over the gate insulating layer 402, the source electrode layer 405*a*, and the drain electrode layer 405*b*.

Figure 16D:
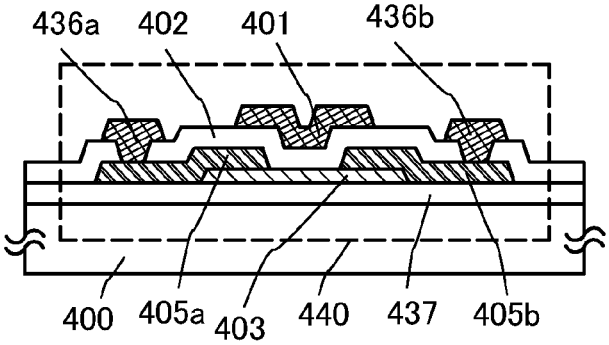

A transistor 440 in FIG. 16D is one of top-gate transistors. The transistor 440 includes, over the substrate 400 having an insulating surface, an insulating layer 437, the oxide semiconductor layer 403, the source electrode layer 405*a*, the drain electrode layer 405*b*, the gate insulating layer 402, and the gate electrode layer 401. A wiring layer 436*a* and a wiring layer 436*b* are formed in contact with and are connected to the source electrode layer 405*a* and the drain electrode layer 405*b*, respectively.

As a semiconductor material used for the semiconductor layer 403, amorphous silicon, microcrystalline silicon, polysilicon, an oxide semiconductor, an organic semiconductor, or the like can be used.

Although there is no particular limitation on a substrate that can be used as the substrate 400 having an insulating surface, a glass substrate made of barium borosilicate glass, aluminoborosilicate glass, or the like can be used.

In the bottom-gate transistors 410, 420, and 430, an insulating film serving as a base film may be provided between the substrate and the gate electrode layer. The base film has a function of preventing diffusion of an impurity element from the substrate, and can be formed to have a single-layer structure or a stacked-layer structure using one or more selected from a silicon nitride film, a silicon oxide film, a silicon nitride oxide film, and a silicon oxynitride film.

The gate electrode layer 401 can be formed to have a single-layer or stacked-layer structure using a metal material such as molybdenum, titanium, chromium, tantalum, tungsten, aluminum, copper, neodymium, or scandium, or an alloy material which contains any of these materials as its main component.

The gate insulating layer 402 can be formed to have a single-layer structure or a stacked-layer structure using a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, or a hafnium oxide layer by a plasma CVD method, a sputtering method, or the like. For example, by a plasma CVD method, a silicon nitride layer ($SiN_y$ (y>0)) with a thickness of greater than or equal to 50 nm and less than or equal to 200 nm is formed as a first gate insulating layer, and a silicon oxide layer ($SiO_x$ (x>0)) with a thickness of greater than or equal to 5 nm and less than or equal to 300 nm is formed as a second gate insulating layer over the first gate insulating layer, so that a gate insulating layer with a total thickness of 200 nm is formed.

As a conductive film used for the source electrode layer 405*a* and the drain electrode layer 405*b*, for example, a metal film containing an element selected from Al, Cr, Cu, Ta, Ti, Mo, and W and a metal nitride film containing any of the above elements as its main component (a titanium nitride film, a molybdenum nitride film, a tungsten nitride film, or the like) can be used. A metal film having a high melting point such as Ti, Mo, or W or a metal nitride film of any of these elements (a titanium nitride film, a molybdenum nitride film, or a tungsten nitride film) may be stacked on one of or both a lower side and an upper side of a metal film of Al, Cu, or the like.

A material similar to that for the source electrode layer 405*a* and the drain electrode layer 405*b* can be used for a conductive film used for the wiring layer 436*a* and the wiring layer 436*b* which are connected to the source electrode layer 405*a* and the drain electrode layer 405*b*, respectively.

Note that the conductive film to be the source electrode layer 405*a* and the drain electrode layer 405*b* (including a wiring layer formed using the same layer as the source electrode layer and the drain electrode layer) may be formed using conductive metal oxide. As conductive metal oxide, indium oxide ($In_2O_3$ or the like), tin oxide ($SnO_2$ or the like), zinc oxide (ZnO or the like), indium oxide-tin oxide alloy ($In_2O_3$—$SnO_2$ or the like; abbreviated to ITO), indium oxide-zinc oxide alloy ($In_2O_3$—ZnO or the like), or any of these metal oxide materials in which silicon oxide is contained can be used.

As the insulating film 407 and the insulating layer 427 provided over the oxide semiconductor layer, and the insulating layer 437 provided under the oxide semiconductor layer, an inorganic insulating film such as a silicon oxide film, a silicon oxynitride film, an aluminum oxide film, or an aluminum oxynitride film can be typically used.

For the protective insulating layer 409 provided over the semiconductor layer, an inorganic insulating film such as a silicon nitride film, an aluminum nitride film, a silicon nitride oxide film, or an aluminum nitride oxide film can be used.

Further, a planarization insulating film may be formed over the protective insulating layer 409 so that surface roughness due to the shape of the transistor is reduced. For the planarization insulating film, an organic material such as polyimide, acrylic, or benzocyclobutene can be used. Other than such organic materials, it is also possible to use a low-dielectric constant material (a low-k material) or the like. Note that the planarization insulating film may be formed by stacking a plurality of insulating films formed from these materials.

This embodiment can be implemented in appropriate combination with the structures described in the other embodiments.

Embodiment 6

In the case where an oxide semiconductor is used as a semiconductor material of the semiconductor layer 403 in the above examples of the transistors in Embodiment 5, it is important to shield the transistor from light. Thus, in this embodiment, an example of a plan view and a cross-sectional view of a pixel included in a liquid crystal display device will be shown and an example of a structure in which the transistor can be shielded from light will be described. Note that as an oxide semiconductor, a material expressed by the chemical formula, $InMO_3(ZnO)_m$ (m>0) can be used. Here, M represents one or more metal elements selected from Ga, Al, Mn, and Co. For example, M can be Ga, Ga and Al, Ga and Mn, Ga and Co, or the like.

Figure 17A:
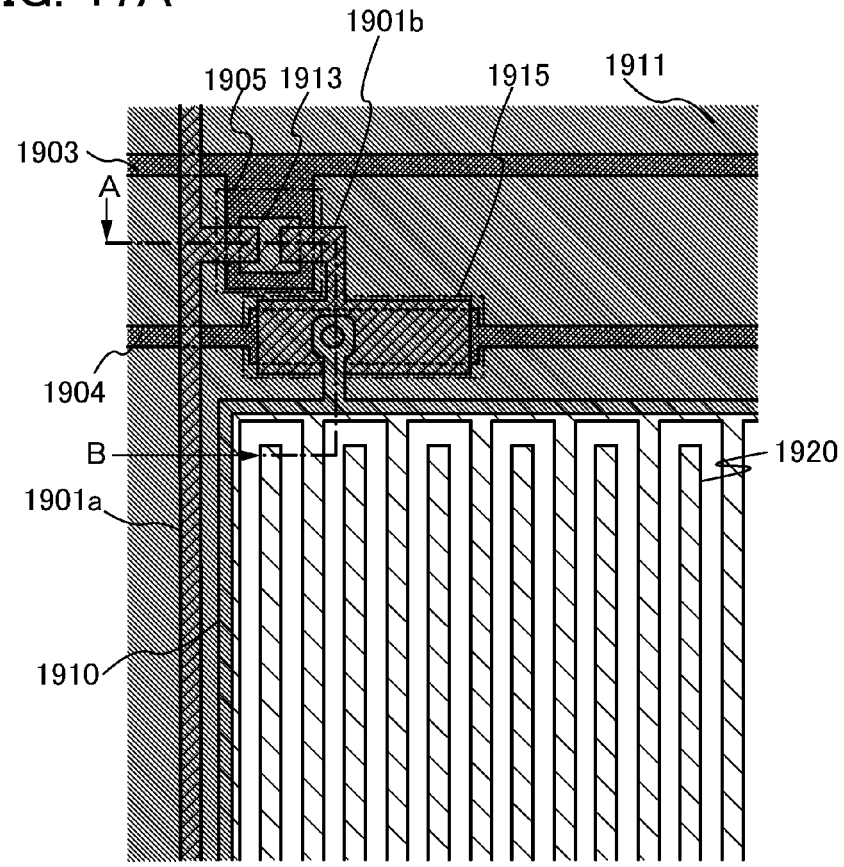
FIG. 17A is a top view and FIG. 17B is a cross-sectional view of one embodiment of the present invention.
Figure 17B:
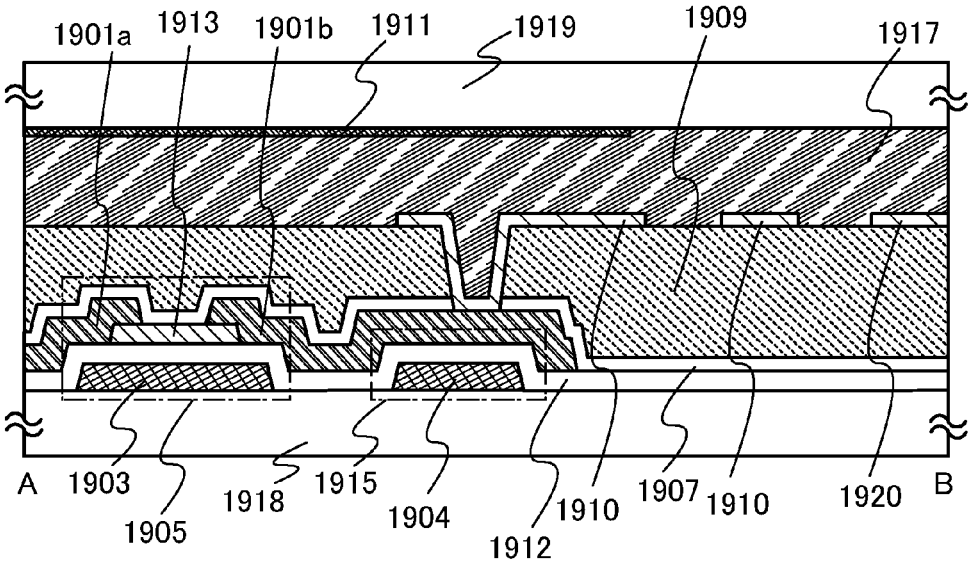

FIG. 17A is an example of a plan view of a pixel. FIG. 17B is a cross-sectional view taken along the alternate long and short dashed line A-B of FIG. 17A.

In FIG. 17A, a signal line which includes a source electrode layer 1901*a* and formed from the same wiring layer as a drain electrode layer 1901*b* are provided to be extended in the vertical direction (a column direction). A wiring layer (including a gate electrode layer 1903) serving as a scan line is provided to extend in a direction approximately orthogonal to the source electrode layer 1901*a* (in a horizontal direction (a row direction) in the drawing). A capacitor wiring layer 1904 is provided to extend in a direction approximately parallel to the gate electrode layer 1903 and approximately orthogonal to the source electrode layer 1901*a* (in a horizontal direction (a row direction) in the drawing).

A transistor 1905 which includes the gate electrode layer 1903 is provided in a pixel illustrated in FIGS. 17A and 17B. In addition, the capacitor wiring layer 1904, a gate insulating layer 1912, and the drain electrode layer 1901*b* are stacked to form a capacitor 1915. An insulating film 1907 and an interlayer film 1909 are provided over the transistor 1905. An opening (a contact hole) is formed in the insulating film 1907 and the interlayer film 1909 which are over the transistor 1905.

The pixel in FIGS. 17A and 17B includes a transparent electrode layer 1910 as an electrode layer connected to the transistor 1905 on the first substrate 1918 side and a transparent electrode layer 1920 as an electrode layer connected to a common potential line (common line). In the opening (contact hole), the transparent electrode layer 1910 and the transistor 1905 are connected to each other. The transparent electrode layer 1910 and the transparent electrode layer 1920 are provided apart from each other with a liquid crystal layer 1917 interposed between comb-like shapes of the transparent electrode layer 1910 and the transparent electrode layer 1920. In a region where the transparent electrode layer 1910 and the transparent electrode layer 1920 are not provided, a light-shielding layer 1911 (black matrix) is provided on the second substrate 1919 side.

The transistor 1905 in FIGS. 17A and 17B includes a semiconductor layer 1913 provided over the gate electrode layer 1903 with the gate insulating layer 1912 interposed therebetween, and the source electrode layer 1901*a* and the drain electrode layer 1901*b* which are in contact with the semiconductor layer 1913.

An insulating layer (the gate insulating layer 1912 and the insulating film 1907 in this embodiment) in contact with the semiconductor layer 1913 including an oxide semiconductor (an oxide semiconductor layer) is preferably formed using an insulating material including a Group 13 element and oxygen. Many of oxide semiconductor materials include a Group 13 element, and thus an insulating material including a Group 13 element works well with an oxide semiconductor. By using such an insulating material including a Group 13 element for an insulating layer in contact with the oxide semiconductor layer, the condition of an interface between the oxide semiconductor layer and the insulating layer can keep a favorable state.

An insulating material including a Group 13 element refers to an insulating material including one or more Group 13 elements. As the insulating material including a Group 13 element, gallium oxide, aluminum oxide, aluminum gallium oxide, and gallium aluminum oxide can be given for example. Here, aluminum gallium oxide refers to a material in which the amount of aluminum is larger than that of gallium in atomic percent, and gallium aluminum oxide refers to a material in which the amount of gallium is larger than or equal to that of aluminum in atomic percent.

For example, in the case where an insulating layer is formed in contact with an oxide semiconductor layer containing gallium, a material including gallium oxide may be used for the insulating layer, so that favorable characteristics can be kept at the interface between the oxide semiconductor layer and the insulating layer. When the oxide semiconductor layer and the insulating layer including gallium oxide are provided in contact with each other, pileup of hydrogen at the interface between the oxide semiconductor layer and the insulating layer can be reduced, for example. Note that a similar effect can be obtained in the case where an element in the same group as a constituent element of the oxide semiconductor is used in the insulating layer. For example, it is effective to form the insulating layer with the use of a material including aluminum oxide. Note that aluminum oxide has a property of not easily transmitting water. Thus, using a material including aluminum oxide is preferable also in terms of preventing entry of water to the oxide semiconductor layer.

The insulating material of the insulating layer in contact with the semiconductor layer 1913 including an oxide semiconductor preferably includes oxygen in a proportion higher than that in the stoichiometric composition by heat treatment under an oxygen atmosphere or oxygen doping. "Oxygen doping" refers to addition of oxygen into a bulk. Note that the term "bulk" is used in order to clarify that oxygen is added not only to a surface of a thin film but also to the inside of the thin film. In addition, "oxygen doping" includes "oxygen plasma doping" in which oxygen which is made to be plasma is added to a bulk. The oxygen doping may be performed using an ion implantation method or an ion doping method.

For example, in the case where the insulating layer in contact with the semiconductor layer 1913 including an oxide semiconductor is formed using gallium oxide, the composition of gallium oxide can be set to be $Ga_2O_x$ ($x=3+\alpha$, $0<\alpha<1$) by heat treatment under an oxygen atmosphere or oxygen doping.

In the case where the insulating layer in contact with the semiconductor layer 1913 including an oxide semiconductor is formed using aluminum oxide, the composition of aluminum oxide can be set to be $Al_2O_x$ ($x=3+\alpha$, $0<\alpha<1$) by heat treatment under an oxygen atmosphere or oxygen doping.

In the case where the insulating layer in contact with the semiconductor layer 1913 including an oxide semiconductor is formed using gallium aluminum oxide (aluminum gallium oxide), the composition of gallium aluminum oxide (aluminum gallium oxide) can be set to be $Ga_xAl_{2-x}O_{3+\alpha}$ ($0<x<2$, $0<\alpha<1$) by heat treatment under an oxygen atmosphere or oxygen doping.

By oxygen doping treatment, an insulating layer which includes a region where the proportion of oxygen is higher than that in the stoichiometric composition can be formed. When the insulating layer including such a region is in contact with the oxide semiconductor layer, oxygen that exists excessively in the insulating layer is supplied to the oxide semiconductor layer, and oxygen deficiency in the oxide semiconductor layer or at an interface between the oxide semiconductor layer and the insulating layer is reduced. Thus, an i-type or substantially i-type oxide semiconductor layer can be formed.

The insulating layer which includes a region where the proportion of oxygen is higher than that in the stoichiometric composition may be applied to either the insulating layer positioned on the upper side of the oxide semiconductor layer or the insulating layer positioned on the lower side of the oxide semiconductor layer of the insulating layers in contact with the semiconductor layer 1913 including an oxide semiconductor. However, it is preferable to apply such an insulating layer to both of the insulating layers in contact with the semiconductor layer 1913 including an oxide semiconductor. The advantageous effect described above can be further enhanced with a structure in which the insulating layers each including a region where the proportion of oxygen is higher than that in the stoichiometric composition are used as the insulating films in contact with and on the upper side and the lower side of the semiconductor layer 1913 including an oxide semiconductor, in order that the semiconductor layer 1913 including an oxide semiconductor is interposed between the insulating layers.

The insulating layers on the upper side and the lower side of the semiconductor layer 1913 including an oxide semiconductor may include the same constituent elements or different constituent elements. For example, the insulating layers on the upper side and the lower side may be both formed using gallium oxide whose composition is $Ga_2O_x$ ($x=3+\alpha$, $0<\alpha<1$). Alternatively, one of the insulating layers on the upper side and the lower side may be formed using $Ga_2O_x$ ($x=3+\alpha$, $0<\alpha<1$) and the other may be formed of aluminum oxide whose composition is $Al_2O_x$ ($x=3+\alpha$, $0<\alpha<1$).

The insulating layer in contact with the semiconductor layer 1913 including an oxide semiconductor may be formed by stacking insulating layers which each include a region where the proportion of oxygen is higher than that in the stoichiometric composition. For example, the insulating layer on the upper side of the semiconductor layer 1913 including an oxide semiconductor may be formed as follows: gallium oxide whose composition is $Ga_2O_x$ ($x=3+\alpha$, $0<\alpha<1$) is formed and gallium aluminum oxide (aluminum gallium oxide) whose composition is $Ga_xAl_{2-x}O_{3+\alpha}$ ($0<x<2$, $0<\alpha<1$) may be formed thereover. Note that the insulating layer on the lower side of the semiconductor layer 1913 including an oxide semiconductor may be formed by stacking insulating layers which each include a region where the proportion of oxygen is higher than that in the stoichiometric composition. Further, both of the insulating layers on the upper side and the lower side of the semiconductor layer 1913 including an oxide semiconductor may be formed by stacking insulating layers which each include a region where the proportion of oxygen is higher than that in the stoichiometric composition.

Moreover, in the plan view of FIG. 17A, the gate electrode layer 1903 is provided so as to cover the lower side of the semiconductor layer 1913 and the light-shielding layer 1911 is provided so as to cover the upper side of the semiconductor layer 1913. Thus, the transistor 1905 can be shielded from light from the upper side and the lower side of the transistor 1905. Deterioration in the transistor characteristics can be reduced by the light shielding.

Figure 18A:
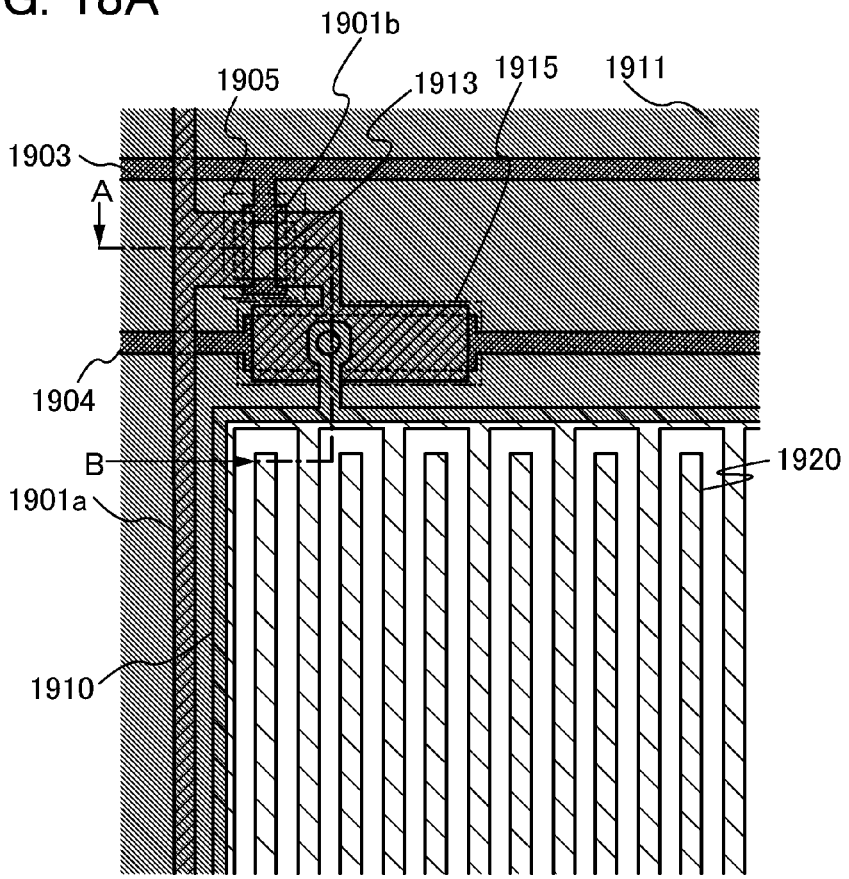
FIG. 18A is a top view and FIG. 18B is a cross-sectional view of one embodiment of the present invention.
Figure 18B:
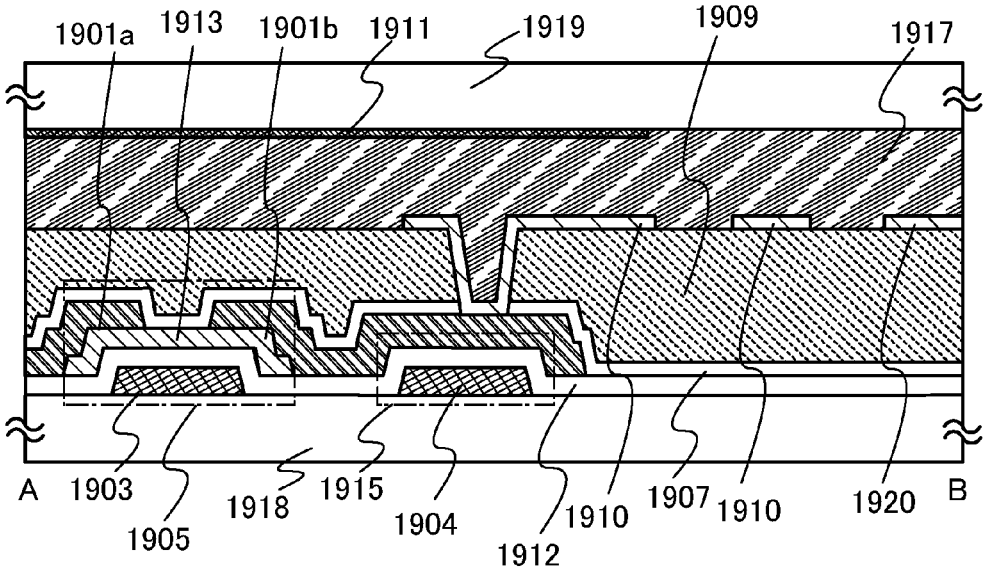

Next, FIG. 18A is an example of a plan view of a pixel which is different from that in FIG. 17A. FIG. 18B is a cross-sectional view taken along the alternate long and short dashed line A-B of FIG. 18A. Note that reference numerals that denote components in FIGS. 18A and 18B are to the same as those in FIGS. 17A and 17B and the description thereof is omitted.

In a structure of the plan view and the cross-sectional view of FIGS. 18A and 18B, which is different from that in FIGS. 17A and 17B, the source electrode layer 1901*a* and the drain electrode layer 1901*b* are provided so as to cover a region other than a region to be a channel formation region of the semiconductor layer 1913. Thus, the transistor 1905 can be shielded from light even also at the end portions of the semiconductor layer 1913. Deterioration in the transistor characteristics can be suppressed by the light shielding.

Figure 19A:
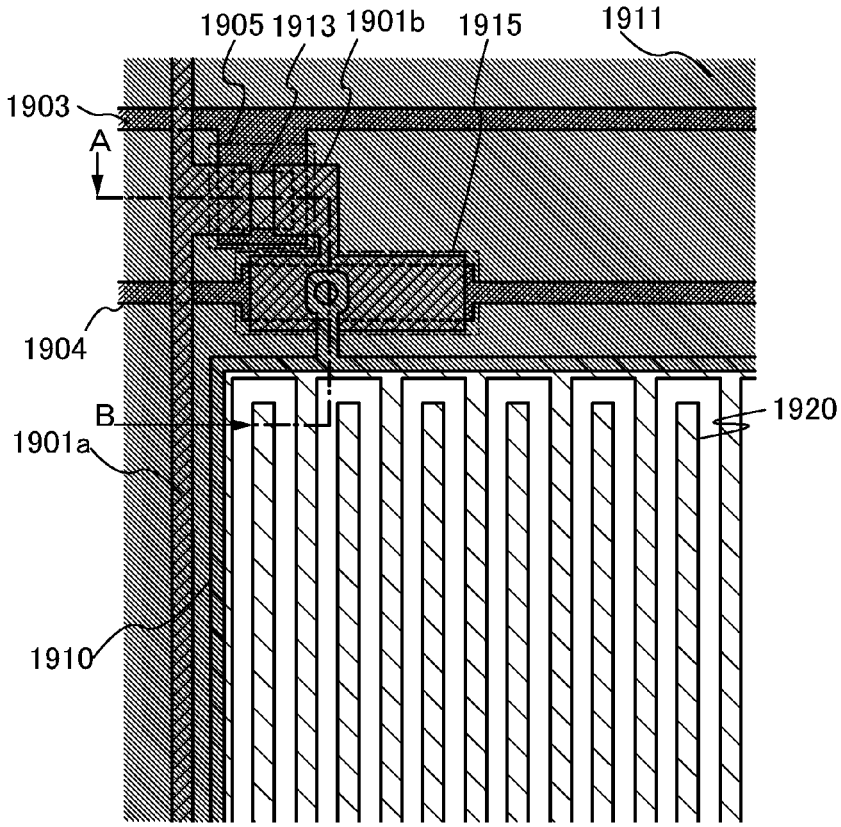
FIG. 19A is a top view and FIG. 19B is a cross-sectional view of one embodiment of the present invention.
Figure 19B:
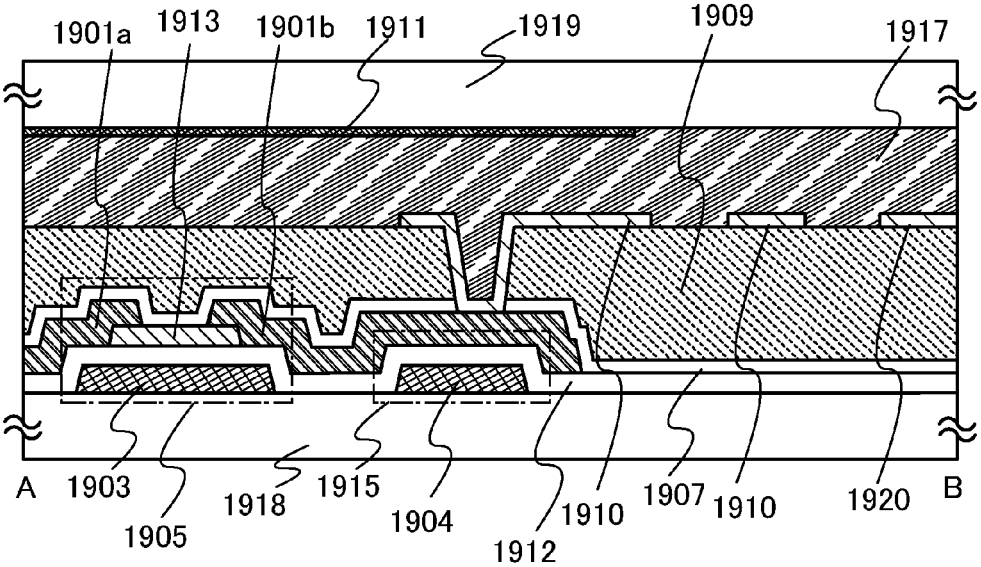

Next, FIG. 19A is an example of a plan view of a pixel which is different from that in FIG. 17A and FIG. 18A. FIG. 19B is a cross-sectional view taken along the alternate long and short dashed line A-B of FIG. 19A. Note that reference numerals that denote components in FIGS. 19A and 19B are to the same as those in FIGS. 17A and 17B and the description thereof is omitted.

In a structure of the plan view and the cross-sectional view of FIGS. 19A and 19B as in the structure of the plan view and the cross-sectional view of FIGS. 17A and 17B, the gate electrode layer 1903 is provided so as to cover the lower side of the semiconductor layer 1913 and the light-shielding layer 1911 is provided so as to cover the upper side of the semiconductor layer 1913. Moreover, in the structure of the plan view and the cross-sectional view of FIGS. 19A and 19B as in the structure of the plan view and the cross-sectional view of FIGS. 18A and 18B, the source electrode layer 1901*a* and the drain electrode layer 1901*b* are provided so as to cover a region other than a region to be a channel formation region of the semiconductor layer 1913. Thus, the upper side and the lower side of the transistor 1905 can be shielded from light, and the transistor 1905 can be shielded from light even also at the end portions of the semiconductor layer 1913. Deterioration in the transistor characteristics can be suppressed by the light shielding.

This embodiment can be implemented in appropriate combination with the structures described in the other embodiments.

Embodiment 7

In this embodiment, one mode of a substrate which is used in the liquid crystal display device according to one embodiment of the present invention will be described.

First, over a manufacturing substrate 6200, a layer 6116 to be separated which includes elements necessary for an element substrate, such as a transistor, an interlayer insulating film, a wiring, and a pixel electrode, and if necessary, a common electrode, a color filter, a black matrix, and an alignment film, with a separation layer 6201 interposed between the manufacturing substrate 6200 and the layer 6116 to be separated.

As the manufacturing substrate 6200, a quartz substrate, a sapphire substrate, a ceramic substrate, a glass substrate, a metal substrate, or the like can be used. An element such as a transistor can be formed with high accuracy over such a substrate having a thickness which is adequate not to have flexibility clearly. The description "adequate not to have flexibility clearly" means that an elastic modulus is almost equivalent to or higher than the elastic modulus of a glass substrate which is normally used in manufacturing a liquid crystal display.

The separation layer 6201 is formed to have a single-layer structure or a stacked-layer structure using an element selected from tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), iridium (Ir), and silicon (Si); an alloy material containing the element as its main component; or a compound material containing the element as its main component by a sputtering method, a plasma CVD method, a coating method, a printing method, or the like.

In the case where the separation layer 6201 has a single-layer structure, it is preferable to form a tungsten layer, a molybdenum layer, or a layer containing a mixture of tungsten and molybdenum. Alternatively, a layer containing an oxide or an oxynitride of tungsten, a layer containing an oxide or an oxynitride of molybdenum, or a layer containing an oxide or an oxynitride of a mixture of tungsten and molybdenum is formed. Note that the mixture of tungsten and molybdenum corresponds to an alloy of tungsten and molybdenum, for example.

In the case where the separation layer 6201 has a stacked-layer structure, preferably, a metal layer is formed as a first layer, and a metal oxide layer is formed as a second layer. Typically, it is preferable to form, as the first layer, a tungsten layer, a molybdenum layer, or a layer containing a mixture of tungsten and molybdenum, and form, as the second layer, an oxide, nitride, oxynitride, or nitride oxide of tungsten, molybdenum, or a mixture of tungsten and molybdenum. In order to form the second metal oxide layer, an oxide layer (e.g., a layer which can be utilized as an insulating layer such as silicon oxide) may be formed over the first metal layer, whereby an oxide of the metal is formed on the surface of the first metal layer.

Figure 20A:
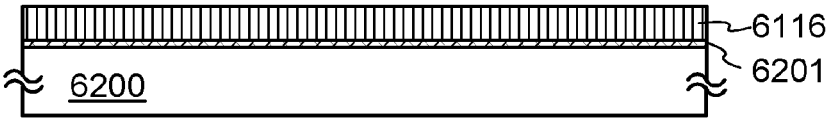
FIGS. 20A to 20E' are cross-sectional views of one embodiment of the present invention.

Subsequently, the layer 6116 to be separated is formed over the separation layer 6201 (see FIG. 20A). The layer 6116 to be separated includes elements necessary for an element substrate, such as a transistor, an interlayer insulating film, a wiring, and a pixel electrode, and if necessary, a common electrode, a color filter, a black matrix, and an alignment film. These elements can be formed over the separation layer 6201 as normal. In such a manner, a transistor and an electrode can be formed with high accuracy using a material and a method which are known.

Figure 20B:
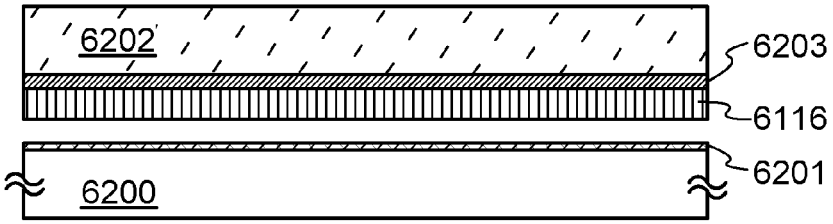

Next, after the layer 6116 to be separated is bonded to a temporary supporting substrate 6202 with an adhesive 6203 for separation, the layer 6116 to be separated is separated from the separation layer 6201 over the manufacturing substrate 6200 and transferred (see FIG. 20B). By this process, the layer 6116 to be separated is provided on the temporary supporting substrate side. Note that in this specification, a process of transferring the layer to be separated from the manufacturing substrate to the temporary supporting substrate is referred to as a transfer process.

As the temporary supporting substrate 6202, a glass substrate, a quartz substrate, a sapphire substrate, a ceramic substrate, a metal substrate, or the like can be used. Alternatively, a plastic substrate which can withstand a subsequent process temperature may be used.

As the adhesive 6203 for separation which is used here, an adhesive which is soluble in water or a solvent, an adhesive which is capable of being plasticized upon irradiation with UV light, and the like are used so that the temporary supporting substrate 6202 and the layer 6166 to be separated can be separated when necessary.

Any of various methods can be used as appropriate as the process for transferring the layer 6116 to be separated to the temporary supporting substrate 6202. When, as the separation layer 6201, a film including a metal oxide film is formed on the side in contact with the layer to be separated, the metal oxide film is weakened by being crystallized, and thus the layer 6116 to be separated can be separated from the manufacturing substrate. When an amorphous silicon film containing hydrogen is formed as the separation layer 6201 between the manufacturing substrate 6200 and the layer 6116 to be separated, the amorphous silicon film containing hydrogen is removed by laser irradiation or etching, whereby the layer 6116 to be separated can be separated from the manufacturing substrate 6200. Furthermore, in the case where a film containing nitrogen, oxygen, hydrogen, or the like (e.g., an amorphous silicon film containing hydrogen, an alloy film containing hydrogen, or an alloy film containing oxygen) is used as the separation layer 6201, the separation layer 6201 is irradiated with laser light to release the nitrogen, oxygen, or hydrogen contained in the separation layer 6201 as a gas, thereby promoting separation between the layer 6116 to be separated and the manufacturing substrate 6200. As another separation method, a method in which the layer 6116 to be separated is separated from the manufacturing substrate 6200 by making liquid penetrate the interface between the separation layer 6201 and the layer 6116 to be separated may be employed. There is also another separation method in which, when the separation layer 6201 is formed using tungsten, the separation is performed while the separation layer 6201 is etched with the use of a mixed solution of ammonia water and a hydrogen peroxide solution.

Further, the separation process can be facilitated by using plural kinds of separation methods described above in combination. That is, the separation can be performed with physical force (by a machine or the like) after laser irradiation is performed on part of the separation layer, etching is performed on part of the separation layer with a gas, a solution, or the like, or mechanical removal of part of the separation layer is performed with a sharp knife, scalpel, or the like, in order that the separation layer and the layer to be separated can be easily separated from each other. In the case where the separation layer 6201 is formed to have a stacked-layer structure of metal and a metal oxide, the layer to be separated can be physically separated easily from the separation layer by using a groove formed by laser irradiation or a scratch made by a sharp knife, a scalpel, or the like as a trigger.

Note that the separation may be performed while a liquid such as water is being poured during the separation.

As a method in which the layer 6116 to be separated is separated from the manufacturing substrate 6200, a method may alternatively be employed in which the manufacturing substrate 6200 over which the layer 6116 to be separated is formed is removed by mechanical polishing or by etching using a solution or a halogen fluoride gas such as $NF_3$, $BrF_3$, or $ClF_3$; or the like. In this case, the separation layer 6201 is not necessarily provided.

Figure 20C:
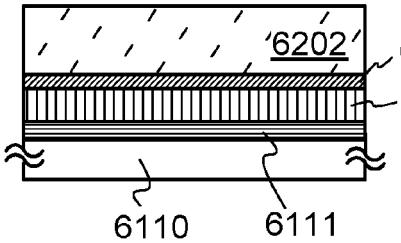
Figure 20C:
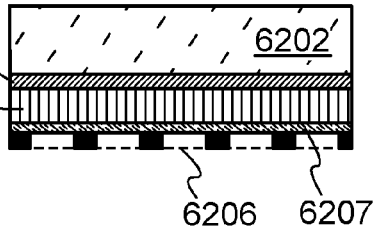

Next, a surface of the layer 6116 to be separated or the separation layer 6201 exposed due to separation of the layer 6116 to be separated from the manufacturing substrate 6200 is bonded to a transfer substrate 6110 with the use of a first adhesive layer 6111 including an adhesive different from the adhesive 6203 for separation (see FIG. 20C).

As a material of the first adhesive layer 6111, any of various curable adhesives, for example, a reactive curable adhesive, a thermal curable adhesive, an anaerobic adhesive, and a light curable adhesive such as a UV curable adhesive can be used.

As the transfer substrate 6110, various substrates with high toughness, such as an organic resin film and a metal substrate, can be preferably used. Substrates with high toughness have high impact resistance and thus are less likely to be damaged. An organic resin film and a thin metal substrate, which are lightweight, enable significant weight reduction as compared to a general glass substrate. When such a substrate is used, it is possible to fabricate a lightweight display device which is not easily damaged.

Figure 20D:
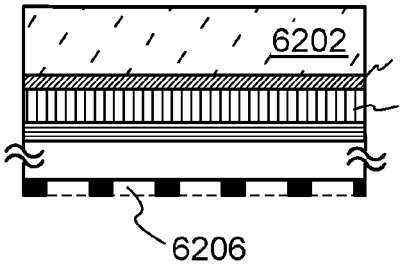
Figure 20D:
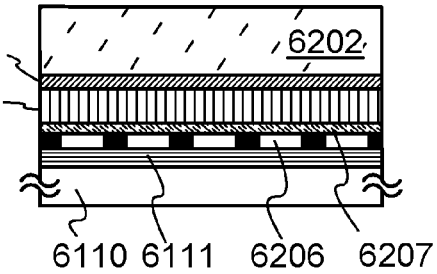

In the case of a transmissive or transflective display device, a substrate which has high toughness and transmits visible light may be used as the transfer substrate 6110. As a material of such a substrate, for example, polyester resins such as polyethylene terephthalate (PET) and polyethylene naphthalate (PEN), an acrylic resin, a polyacrylonitrile resin, a polyimide resin, a polymethyl methacrylate resin, a polycarbonate (PC) resin, a polyethersulfone (PES) resin, a polyamide resin, a cycloolefin resin, a polystyrene resin, a polyamide imide resin, and a polyvinylchloride resin can be given. A substrate made of such an organic resin has high toughness and thus has high impact resistance and is less likely to be damaged. Further, a film of such an organic resin, which is lightweight, enables significant reduction in weight of a display device as compared to a general glass substrate. In that case, the transfer substrate 6110 is preferably further provided with a metal plate 6206 having an opening at least in a portion overlapping with a region where light of each pixel is transmitted. With the above structure, the transfer substrate 6110 which has high toughness and high impact resistance and is less likely to be damaged can be formed while a change in dimension is suppressed. Further, when the thickness of the metal plate 6206 is reduced, the transfer substrate 6110 which is lighter than a general glass substrate can be formed. When such a substrate is used, it is possible to fabricate a lightweight display device which is not easily damaged (see FIG. 20D).

Figure 21A:
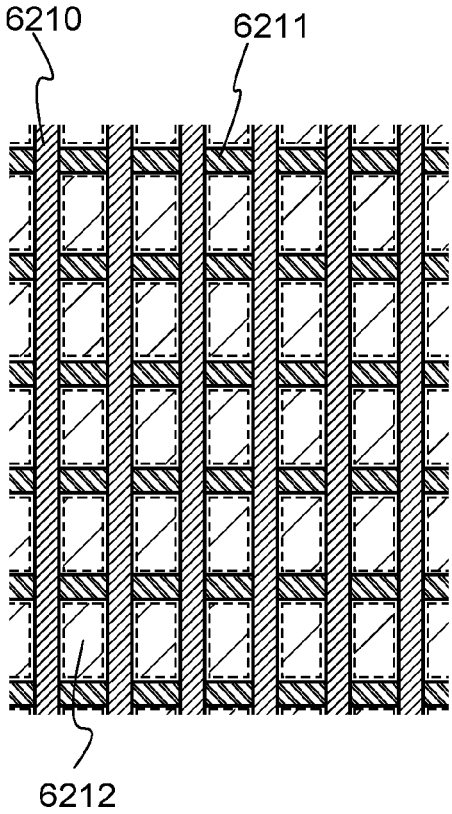
FIGS. 21A to 21C are top views of one embodiment of the present invention.
Figure 21B:
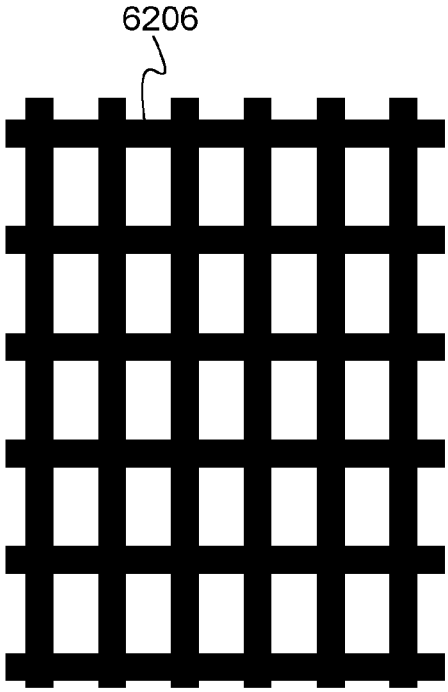
Figure 21C:
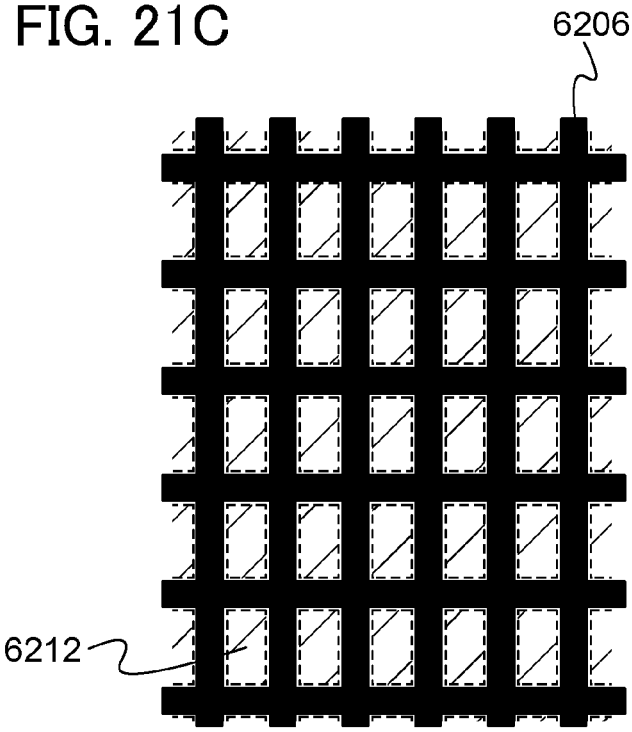

FIG. 21A is an example of a top view of a liquid crystal display device. FIG. 21A is a top view in which a first wiring layer 6210 and a second wiring layer 6211 intersect with each other, and a region surrounded by the first wiring layer 6210 and the second wiring layer 6211 includes a light-transmitting region 6212. In this case, as in FIG. 21B, the metal plate 6206 having openings formed in a grid so as to leave a portion overlapping with the first wiring layer 6210 and/or the second wiring layer 6211 may be used. The state of FIG. 21C can be obtained by attaching the metal plate 6206 as illustrated in FIG. 21B to the top view of FIG. 21A. Consequently, it is possible to suppress a change in dimension due to unfavorable alignment or extension of a substrate because of the use of a substrate made of an organic resin. Note that when a polarizing plate (not illustrated) is necessary, it may be provided between the transfer substrate 6110 and the metal plate 6206 or outside the metal plate 6206. The polarizing plate may be attached to the metal plate 6206 in advance. Note that in terms of weight reduction, a substrate which is thin but has dimension stability is preferably used as the metal plate 6206.

Figure 20E:
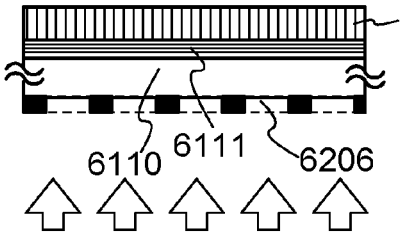
Figure 20E:
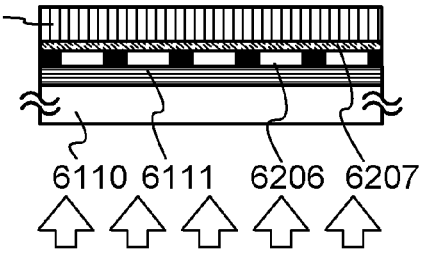

After that, the temporary supporting substrate 6202 is separated from the layer 6116 to be separated. Since the adhesive 6203 for separation includes a material capable of separating the temporary supporting substrate 6202 and the layer 6116 to be separated from each other when necessary, the temporary supporting substrate 6202 may be separated by a method depending on the material. Note that lights from the backlight portion are emitted as shown by arrows in the drawing (see FIG. 20E).

Thus, the layer 6116 to be separated, which is provided with components such as the transistor and the pixel electrode (a common electrode, a color filter, a black matrix, an alignment film, or the like may be provided as necessary), can be formed over the transfer substrate 6110, whereby a lightweight element substrate with high impact resistance can be formed.

Modification Example

The display device having the above structure is one embodiment of the present invention, and the present invention also includes a display device having a structure different from that of the above display device. After the above transfer process (FIG. 20B), the metal plate 6206 may be attached to a surface of the exposed separation layer 6201 or the layer 6116 to be separated before attachment of the transfer substrate 6110 (see FIG. 20C'). In that case, a barrier layer 6207 is preferably provided between the metal plate 6206 and the layer 6116 to be separated so that a contaminant from the metal plate 6206 can be prevented from adversely affecting characteristics of the transistor in the layer 6116 to be separated. In the case where the barrier layer 6207 is provided, the barrier layer 6207 may be provided over the surface of the exposed separation layer 6201 or the layer 6116 to be separated before attachment of the metal plate 6206. The barrier layer 6207 may be formed using an inorganic material, an organic material, or the like, typically, silicon nitride and the like. A material of the barrier layer is not limited to the above as long as contamination of the transistor can be prevented. The barrier layer 6207 is formed using a light-transmitting material or formed to a thickness small enough to transmit light so that the barrier layer can transmit at least visible light. Note that the metal plate 6206 may be bonded with the use of a second adhesive layer (not illustrated) including an adhesive different from the adhesive 6203 for separation.

After that, the first adhesive layer 6111 is formed over a surface of the metal plate 6206 and the transfer substrate 6110 is attached to the first adhesive layer 6111 (FIG. 20D') and the temporary supporting substrate 6202 is separated from the layer 6116 to be separated (FIG. 20E'), whereby a lightweight element substrate with high impact resistance can be formed similarly. Note that lights from the backlight portion are emitted as shown by arrows in the drawing.

The lightweight element substrate with high impact resistance formed as described above is firmly attached to a counter substrate with the use of a sealant with a liquid crystal layer provided between the substrates, whereby a lightweight liquid crystal display device with high impact resistance can be manufactured. As the counter substrate, a substrate which has high toughness and transmits visible light (similar to a plastic substrate which can be used as the transfer substrate 6110) can be used. Further, a polarizing plate, a color filter, a black matrix, a common electrode, or an alignment film may be provided as necessary. As a method for forming the liquid crystal layer, a dispenser method, an injection method, or the like can be employed as in the conventional case.

In the case of the lightweight liquid crystal display device with high impact resistance manufactured as described above, a fine element such as the transistor can be formed over a glass substrate or the like which has relatively high dimensional stability, and the conventional manufacturing method can be applied, so that even such a fine element can be formed precisely. Therefore, the lightweight liquid crystal display device with high impact resistance can display images with high precision and high quality.

Further, the liquid crystal display device manufactured as described above may be flexible.

This embodiment can be implemented in appropriate combination with the structures described in the other embodiments.

Embodiment 8

Figure 22A:
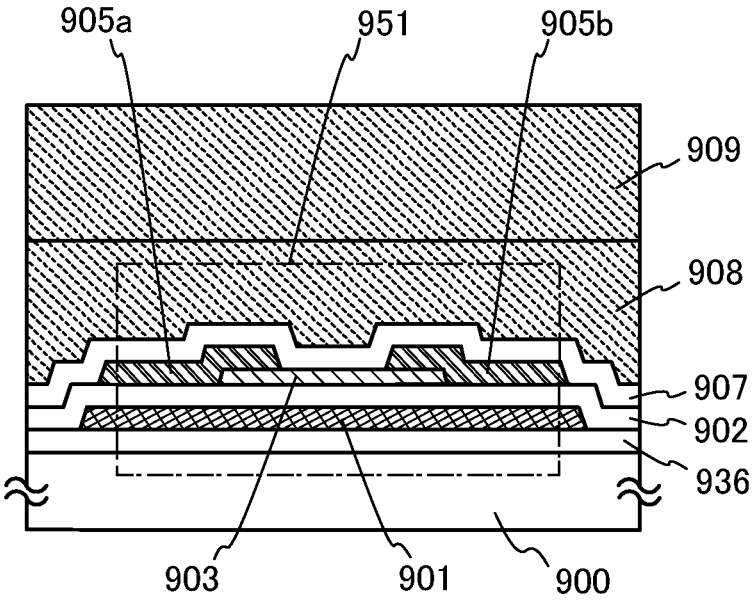
FIGS. 22A and 22B are each a cross-sectional view of a structure of a transistor.
Figure 22B:
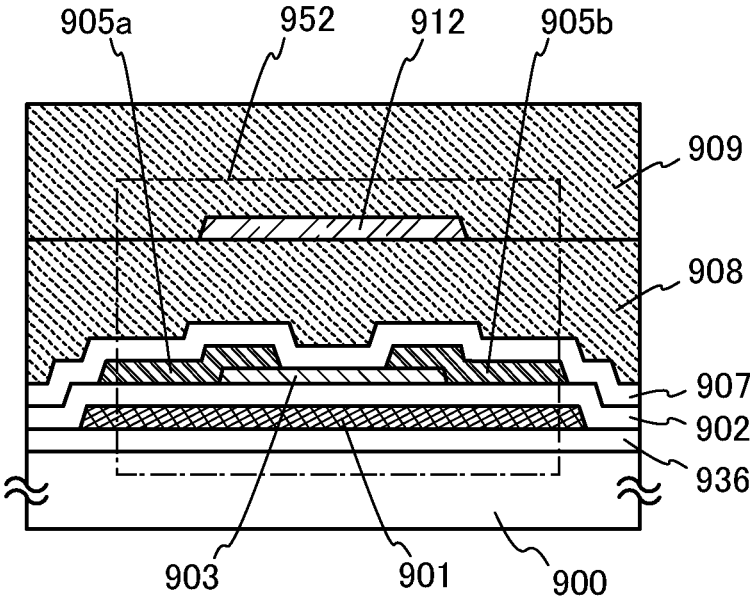

In this embodiment, a specific example of an effect due to light shielding on a transistor manufactured using an oxide semiconductor will be shown and the effect will be described in detail. In this embodiment, as illustrated in FIGS. 22A and 22B, two kinds of transistors are manufactured: a transistor 951 as a transistor which is not shielded from light and a transistor 952 having a back gate electrode as a transistor which is shielded from light. Note that FIG. 23 and FIGS. 24A to 24C show evaluation results of the amount of change of threshold voltage (Vth) between before and after the negative-bias temperature stress photodegradation tests which are applied to the transistors.

First, a stacked-layer structure of the transistor 951 and a manufacturing method thereof will be described with reference to FIGS. 22A and 22B. Over a substrate 900, a base layer 936 is formed by stacking silicon nitride having a thickness of 200 nm and silicon oxynitride having a thickness of 400 nm by a CVD method. Next, over the base layer 936, tantalum nitride having a thickness of 30 nm and tungsten having a thickness of 100 nm are stacked by a sputtering method and selectively etched, whereby a gate electrode 901 is formed.

Next, silicon oxynitride having a thickness of 30 nm is formed as a gate insulating layer 902 over the gate electrode 901 by a high-density plasma CVD method.

Then, an oxide semiconductor having a thickness of 30 nm is formed over the gate insulating layer 902 by a sputtering method using an In—Ga—Zn—O-based metal oxide target. Then, an island-shaped oxide semiconductor layer 903 is formed by selectively etching the oxide semiconductor.

Next, first heat treatment is performed at 450° C. under a nitrogen atmosphere for 60 minutes.

Next, titanium having a thickness of 100 nm, aluminum having a thickness of 200 nm, and titanium having a thickness of 100 nm are stacked over the oxide semiconductor layer 903 by a sputtering method and selectively etched, whereby a source electrode 905*a* and a drain electrode 905*b* are formed.

Next, second heat treatment is performed at 300° C. under a nitrogen atmosphere for 60 minutes.

Next, silicon oxide is formed by a sputtering method as an insulating layer 907 which is in contact with part of the oxide semiconductor layer 903 and over the source electrode 905*a* and the drain electrode 905*b*, and a polyimide resin having a thickness of 1.5 μm is formed as an insulating layer 908 over the insulating layer 907.

Next, third heat treatment is performed at 250° C. under a nitrogen atmosphere for 60 minutes.

Next, a polyimide resin having a thickness of 2.0 μm is formed as an insulating layer 909 over the insulating layer 908.

Next, fourth heat treatment is performed at 250° C. under a nitrogen atmosphere for 60 minutes.

The transistor 952 in FIG. 22B can be formed in a manner similar to that of the transistor 951. Note that the transistor 952 is different from the transistor 951 in that a back gate electrode 912 is formed between the insulating layer 908 and the insulating layer 909. Titanium having a thickness of 100 nm, aluminum having a thickness of 200 nm, and titanium having a thickness of 100 nm are stacked over the insulating layer 908 by a sputtering method and selectively etched, whereby the back gate electrode 912 is formed. Note that the back gate electrode 912 is electrically connected to the source electrode 905*a*.

The channel length of each of the transistor 951 and the transistor 952 is 3 μm, and the channel width of each of the transistor 951 and the transistor 952 is 20 μm.

Then, negative-bias temperature stress photodegradation tests performed on the transistor 951 and the transistor 952 which are formed in this embodiment will be described.

The negative-bias temperature stress photodegradation test is a kind of acceleration test and characteristic variations of a transistor in an environment where the transistor is irradiated with light can be measured in a short time. In particular, the amount of shift in Vth of the transistor in the negative-bias temperature stress photodegradation test is an important indicator for examining reliability. As the amount of shift in the Vth in the negative-bias temperature stress photodegradation test is small, the transistor has higher reliability. It is preferable that the amount of shift in the Vth between before and after the negative-bias temperature stress photodegradation tests be less than or equal to 1 V, preferably less than or equal to 0.5 V.

Specifically, the negative-bias temperature stress photodegradation test is performed in such a manner that the temperature of a substrate over which a transistor is formed (substrate temperature) is set at fixed temperature, a source electrode and a drain electrode of the transistor are set at the same potential, and a gate electrode is supplied with a potential which is lower than those of the source electrode and the drain electrode for a certain period while the transistor is irradiated with light.

Strength of the negative-bias temperature stress photodegradation test can be determined based on the light irradiation conditions, the substrate temperature, and the intensity of an electric field and time period of application of the electric field to the gate insulating layer. The intensity of the electric field applied to the gate insulating layer is determined in accordance with a value obtained by dividing a potential difference between the gate electrode, and the source electrode and the drain electrode by the thickness of the gate insulating layer. For example, in the case where the intensity of the electric field applied to the gate insulating layer having a thickness of 100 nm is desired to be 2 MV/cm, the potential difference may be set to 20 V.

Note that a test which is performed in such a manner that a potential higher than a potential of the source electrode and the drain electrode is applied to the gate electrode in an environment where the transistor is irradiated with light is called a positive-bias temperature stress photodegradation test. Variations in characteristics of a transistor easily occur using the negative-bias temperature stress photodegradation test, as compared to those using the positive-bias temperature stress photodegradation test; therefore, a measurement is performed using the negative-bias temperature stress photodegradation test in this embodiment.

The negative-bias temperature stress photodegradation test in this embodiment is performed under such conditions that a substrate temperature is a room temperature (25° C.), the intensity of the electric field applied to the gate insulating layer 902 is 2 MV/cm, and a time period for light irradiation and electric field application is one hour. Further, a xenon light source "MAX-302" manufactured by Asahi Spectra Co., Ltd. is used, and light irradiation conditions are set as follows: peak wavelength is 400 nm (half width is 10 nm) and irradiance is 326 $\mu W/cm^2$.

First, initial characteristics of a transistor which is a test object are measured before the negative-bias temperature stress photodegradation test. In this embodiment, the variation in characteristics of the current between the source electrode and the drain electrode (hereinafter referred to as drain current or Id), i.e., Vg-Id characteristics are measured when the substrate temperature is set to a room temperature (25° C.), the voltage between the source electrode and the drain electrode (hereinafter drain voltage or Vd) is set to 3 V, and the voltage between the source electrode and the gate electrode (hereinafter gate voltage or Vg) is varied from −5 V to +5 V.

Next, light irradiation starts from the insulating layer 908 side, and negative voltage is applied to the gate electrode 901 so that a potential of the source electrode and the drain electrode of the transistor is 0 V and the intensity of the electric field applied to the gate insulating layer 902 of the transistor is 2 MV/cm. Since the thickness of the gate insulating layer 902 in each of the transistors is 30 nm here, a voltage of −6 V is kept being applied to the gate electrode 901 for one hour. The time of voltage application is one hour here; however, the time may be determined as appropriate in accordance with the purpose.

Next, application of voltage is terminated, and Vg-Id characteristics are measured under the same conditions as the measurement of the initial characteristics while light irradiation continues to be performed, whereby Vg-Id characteristics after the negative-bias temperature stress photodegradation test are obtained.

Figure 23:
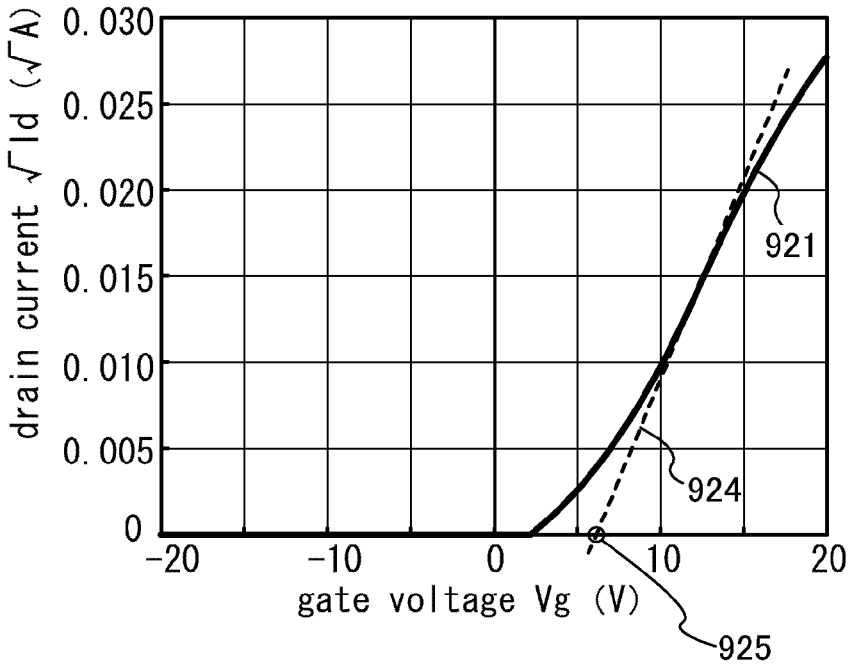
FIG. 23 is a graph for illustrating definition of Vth.

Here, the definition of Vth in this embodiment will be described with reference to FIG. 23. In FIG. 23, the horizontal axis represents the gate voltage on a linear scale, and the vertical axis represents a square root of drain current (hereinafter also referred to as √Id) on a linear scale. A curve 921 is a curve expressed by square roots of Id values in the Vg-Id characteristics (hereinafter the curve is also referred to as an √Id curve).

First, an √Id curve (the curve 921) is obtained from the Vg-Id curve obtained by measurement. Then, a tangent line 924 at a point on the √Id curve at which a differential value of the √Id curve is a maximum value is obtained. Then, Vg at a point where Id is 0 A on the tangent line 924, that is, a value at a gate valtage axis intercept 925 of the tangent line 924 is defined as Vth.

Figure 24A:
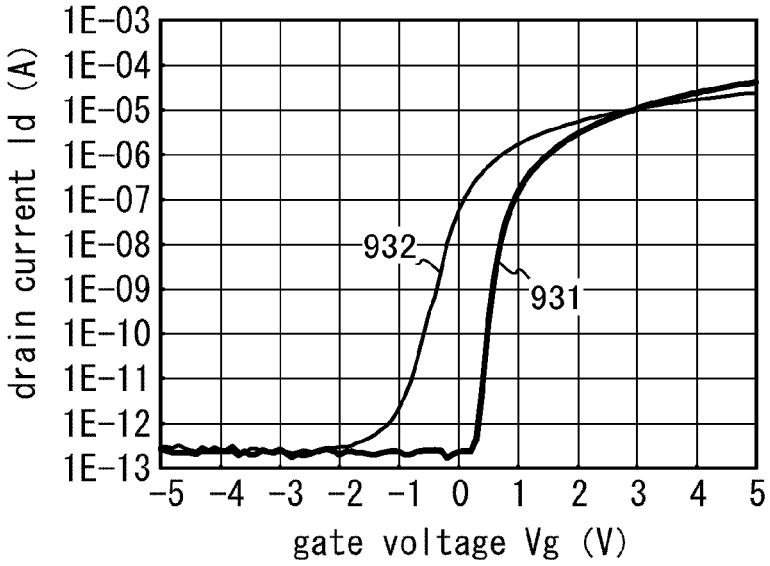
FIGS. 24A and 24B are graphs each showing results of a light negative bias test.
Figure 24B:
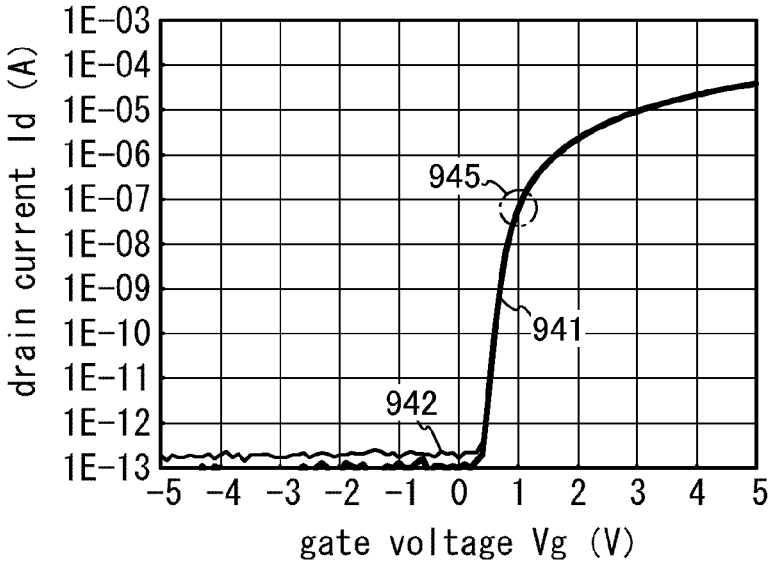
Figure 24C:
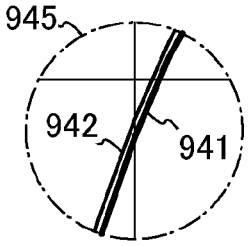
FIG. 24C shows an enlarged view of a portion of FIG. 24B.

FIGS. 24A to 24C show Vg-Id characteristics of the transistor 951 and the transistor 952 before and after the negative-bias temperature stress photodegradation tests. In each of FIGS. 24A and 24B, the horizontal axis represents the gate voltage (Vg), and the vertical axis represents the drain current (Id) which is shown with a logarithmic scale.

FIG. 24A shows the Vg-Id characteristics of the transistor 951 before and after the negative-bias temperature stress photodegradation test. A curve 931 shows the initial Vg-Id characteristics of the transistor 951 before the negative-bias temperature stress photodegradation test. A curve 932 shows the Vg-Id characteristics of the transistor 951 after the negative-bias temperature stress photodegradation test. The Vth of the initial characteristics shown by the curve 931 is 1.01 V, and the Vth of the characteristics shown by the curve 932 after the test is 0.44 V.

FIG. 24B shows the Vg-Id characteristics of the transistor 952 before and after the negative-bias temperature stress photodegradation test. FIG. 24C is an enlarged view of a portion 945 in FIG. 24B. A curve 941 shows the initial Vg-Id characteristics of the transistor 952 before the negative-bias temperature stress photodegradation test. A curve 942 shows the Vg-Id characteristics of the transistor 952 after the negative-bias temperature stress photodegradation test. The Vth of the initial characteristics shown by the curve 941 is 1.16 V, and the Vth of the characteristics shown by the curve 942 after the test is 1.10 V. Note that the back gate electrode 912 of the transistor 952 is electrically connected to the source electrode 905*a*; therefore, the potential of the back gate electrode 912 is the same as the potential of the source electrode 905*a*.

In FIG. 24A, the Vth of the characteristics shown by the curve 932 after the test shifts in a negative direction by 0.57 V from that of the initial characteristics shown by the curve 931. In FIG. 24B, the Vth of the characteristics shown by the curve 942 after the test shifts in a negative direction by 0.06 V from that of the initial characteristics shown by the curve 941. It can be confirmed that the amount of shift in the Vth of each of the transistor 951 and the transistor 952 is less than or equal to 1 V and that each of the transistor 951 and the transistor 952 has high reliability. It can also be confirmed that the amount of shift in the Vth of the transistor 952 provided with the back gate electrode 912 is less than or equal to 0.1 V and that the transistor 952 has higher reliability than the transistor 951.

This embodiment can be implemented in appropriate combination with the structures described in the other embodiments.

Embodiment 9

A display device disclosed in this specification can be applied to a variety of electronic devices (including game machines). Examples of electronic devices are a television set (also referred to as a television or a television receiver), a monitor of a computer or the like, a camera such as a digital camera or a digital video camera, a digital photo frame, a mobile phone handset (also referred to as a mobile phone or a mobile phone device), a portable game machine, a portable information terminal, an audio reproducing device, a large-sized game machine such as a pachinko machine, and the like. Examples of electronic devices each including any of the display devices described in the above embodiment will be described.

Figure 13A:
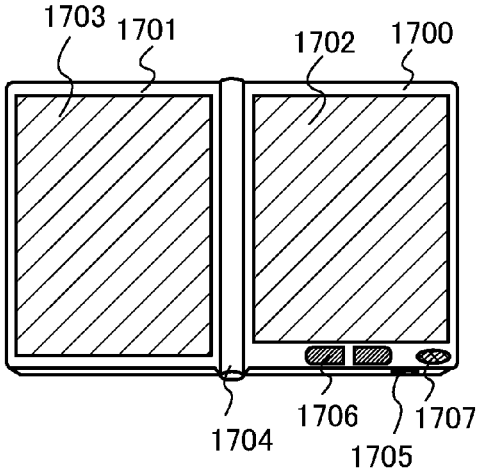
FIGS. 13A to 13D are diagrams each illustrating an electronic device of one embodiment of the present invention.

FIG. 13A shows an example of an e-book reader. The e-book reader in FIG. 13A includes two housings, a housing 1700 and a housing 1701. The housing 1700 and the housing 1701 are combined with each other by a hinge 1704 so that the e-book reader can be opened and closed. With such a structure, the e-book reader can handled like a paper book.

A display portion 1702 and a display portion 1703 are incorporated in the housing 1700 and the housing 1701, respectively. The display portion 1702 and the display portion 1703 may be configured to display continuous image or different images. In the case where the display portion 1702 and the display portion 1703 display different images, for example, a display portion on the right side (the display portion 1702 in FIG. 13A) can display text and a display portion on the left side (the display portion 1703 in FIG. 13A) can display images.

FIG. 13A shows an example in which the housing 1700 includes an operation portion and the like. For example, the housing 1700 is provided with a power supply input terminal 1705, operation keys 1706, a speaker 1707, and the like. With the operation key 1706, pages can be turned. Note that a keyboard, a pointing device, or the like may be provided on the same surface as the display portion of the housing. Further, an external connection terminal (an earphone terminal, a USB terminal, a terminal that can be connected to various cables such as a USB cable, or the like), a recording medium insert portion, or the like may be provided on the back surface or the side surface of the housing. Further, the e-book reader in FIG. 13A may have a function of an electronic dictionary.

Figure 13B:
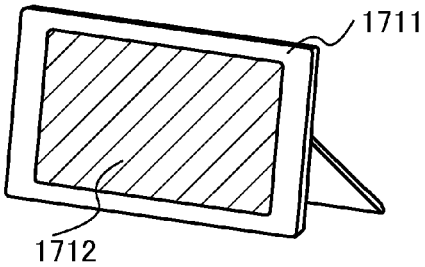

FIG. 13B shows an example of a digital photo frame using a display device. For example, in the digital photo frame in FIG. 13B, a display portion 1712 is incorporated in a housing 1711. The display portion 1712 can display various images. For example, the display portion 1712 can display data of an image taken with a digital camera or the like and function as a normal photo frame.

Note that the digital photo frame in FIG. 13B may be provided with an operation portion, an external connection terminal (a USB terminal, a terminal which can be connected to a variety of cables such as a USB cable, and the like), a recording medium insertion portion, and the like. Although these components may be provided on the surface on which the display portion is provided, it is preferable to provide them on the side surface or the back surface for the design of the digital photo frame. For example, a memory storing data of an image taken with a digital camera is inserted in the recording medium insertion portion of the digital photo frame, whereby the image data can be transferred and then displayed on the display portion 1712.

Figure 13C:
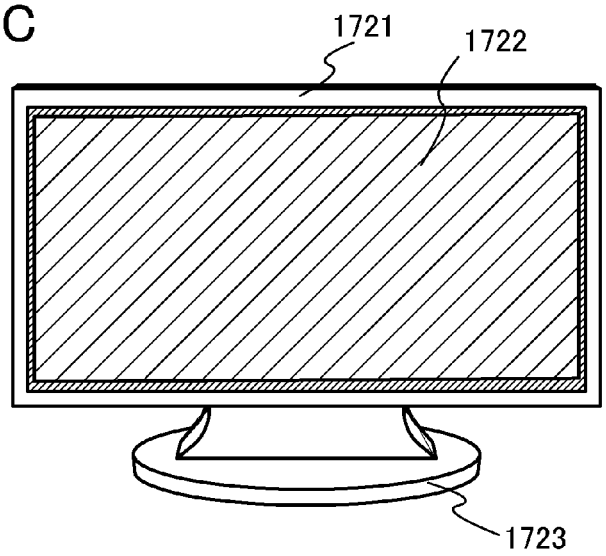

FIG. 13C shows an example of a television set including a display device. In the television set in FIG. 13C, a display portion 1722 is incorporated in a housing 1721. The display portion 1722 can display an image. Further, the housing 1721 is supported by a stand 1723 in this example. Any of the display devices described in the above embodiment can be used for the display portion 1722.

The television set in FIG. 13C can operate by an operation switch of the housing 1721 or a separate remote controller. Channels and volume can be controlled with an operation key of the remote controller so that an image displayed on the display portion 1722 can be controlled. Further, the remote controller may be provided with a display portion for displaying data output from the remote controller.

Figure 13D:
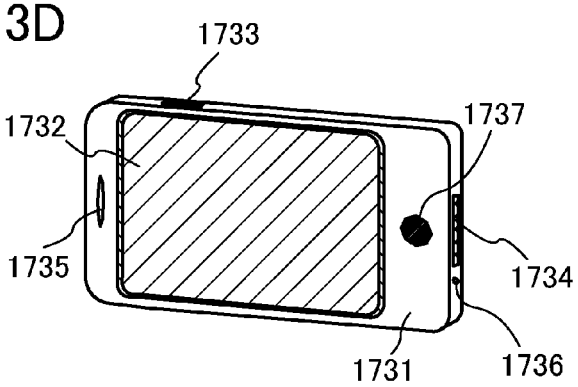

FIG. 13D shows an example of a mobile phone handset including a display device. The mobile phone handset in FIG. 13D is provided with a display portion 1732 incorporated in a housing 1731, an operation button 1733, an operation button 1737, an external connection port 1734, a speaker 1735, a microphone 1736, and the like.

The display portion 1732 of the mobile phone handset in FIG. 13D is a touch panel. When the display portion 1732 is touched with a finger or the like, contents displayed on the display portion 1732 can be controlled. Further, operations such as making calls and texting can be performed by touching the display portion 1732 with a finger or the like.

This embodiment can be implemented in appropriate combination with the structures described in the other embodiments.

This application is based on Japanese Patent Application serial No. 2010-151814 filed with the Japan Patent Office on Jul. 2, 2010, the entire contents of which are hereby incorporated by reference.

What is claimed is:

1. A method for driving a display device comprising a backlight portion having a light source region divided into a first region, a second region, a third region, and a fourth region; and a pixel portion which is divided into a first pixel region, a second pixel region, a third pixel region, and a fourth pixel region corresponding to the first region, the second region, the third region, and the fourth region, respectively, wherein the display device is displayed by a field sequential method, and wherein one-frame period comprises a plurality of subframe periods including a first subframe period, a second subframe period, and a third subframe period consecutively in this order, comprising the steps of:

in the first subframe period, performing light emission at the same time in the first region and in the third region; performing non-light emission at the same time in the second region and in the fourth region, wherein a color of light emission in the first region is different from a color of light emission in the third region;

in the second subframe period, performing light emission at the same time in the second region and in the fourth region; performing non-light emission at the same time in the first region and in the third region, wherein a color of light emission in the second region and a color of light emission in the fourth region are different from each other;

and in the third subframe period, performing light emission at the same time in the first region and in the third region; performing non-light emission at the same time in the second region and in the fourth region, wherein a color of light emission in the first region is different from a color of light emission in the third region, wherein light emission or non-light emission is performed in the first region and in the third region, which are separated from each other with the second region interposed therebetween; and light emission or non-light emission is performed in the second region and in the fourth region, which are separated from each other with the third region interposed therebetween, wherein a color of light emission in the first region in the first subframe period is the same as a color of light emission in the second region in the second subframe period, and wherein the color of light emission in the second region in the second subframe period is different from a color of light emission in the third region in the third subframe period.

2. The method for driving a display device according to claim 1, wherein color display is performed by using red, green, and blue.

3. The method for driving a display device according to claim 1, wherein the plurality of subframe periods includes a subframe period in which a whole of the light source region emits no light.

4. The method for driving a display device according to claim 1, wherein the display device is a liquid crystal display device.

5. A method for driving a display device comprising a backlight portion having a light source region which is divided into a first region, a second region, a third region, a fourth region, a fifth region, and a sixth region; and a pixel portion which is divided into a first pixel region, a second pixel region, a third pixel region, a fourth pixel region, a fifth pixel region, and a sixth pixel region corresponding to the first region, the second region, the third region, the fourth region, the fifth region, and the sixth region, respectively, wherein the display device is displayed by a field sequential method, and wherein one-frame period comprises a plurality of subframe periods including a first subframe period, a second subframe period, and a third subframe period consecutively in this order, comprising the steps of:

in the first subframe period, performing light emission at the same time in the first region, in the third region, and in the fifth region; performing non-light emission at the same time in the second region, in the fourth region, and in the sixth region, wherein a color of light emission in the first region, a color of light emission in the third region and a color of light emission in the fifth region are different from one another;

in the second subframe period, performing light emission at the same time in the second region, in the fourth region, and in the sixth region; performing non-light emission at the same time in the first region, in the third region, and in the fifth region, wherein a color of light emission in the second region, a color of light emission in the fourth region, and a color of light emission in the sixth region are different from one another; and in the third subframe period, performing light emission at the same time in the first region, in the third region, and in the fifth region; performing non-light emission at the same time in the second region, in the fourth region, and in the sixth region, wherein a color of light emission in the first region, a color of light emission in the third region and a color of light emission in the fifth region are different from one another, wherein light emission or non-light emission is performed in the first region and in the third region, which are separated from each other with the second region interposed therebetween; light emission or non-light emission is performed in the second region and in the fourth region, which are separated from each other with the third region interposed therebetween; light emission or non-light emission is performed in the third region and in the fifth region, which are separated from each other with the fourth region interposed therebetween; and light emission or non-light emission is performed in the fourth region and in the sixth region, which are separated from each other with the fifth region interposed therebetween, wherein a color of light emission in the first region in the first subframe period is the same as a color of light emission in the second region in the second subframe period, wherein the color of light emission in the second region in the second subframe period is different from a color of light emission in the third region in the third subframe period, wherein a color of light emission in the third region in the first subframe period is the same as a color of light emission in the fourth region in the second subframe period, and wherein the color of light emission in the fourth region in the second subframe period is different from a color of light emission in the fifth region in the third subframe period.

6. The method for driving a display device according to claim 5, wherein color display is performed by using red, green, and blue.

7. The method for driving a display device according to claim 5, wherein the plurality of subframe periods includes a subframe period in which a whole of the light source region emits no light.

8. The method for driving a display device according to claim 5, wherein the display device is a liquid crystal display device.

9. A method for driving a display device comprising a backlight portion having a light source region which is divided into a first region, a second region, a third region, and a fourth region; and a pixel portion which is divided into a first pixel region, a second pixel region, a third pixel region, and a fourth pixel region corresponding to the first region, the second region, the third region, and the fourth region, respectively, wherein the display device is displayed by a field sequential method, and wherein one-frame period comprises a plurality of subframe periods including a first subframe period, a second subframe period, a third subframe period consecutively in this order, and further including a fourth subframe period, and fifth subframe period, comprising the steps of:

in the first subframe period, performing light emission at the same time in the first region and in the third region; performing non-light emission at the same time in the second region and in the fourth region, wherein a color of light emission in the first region and a color of light emission in the third region are different from each other;

in the second subframe period, performing light emission at the same time in the second region and in the fourth region; performing non-light emission at the same time in the first region and in the third region, wherein a color of light emission in the second region and a color of light emission in the fourth region are different from each other;

in the third subframe period, performing light emission at the same time in the first region and in the third region; performing non-light emission at the same time in the second region and in the fourth region, wherein a color of light emission in the first region and a color of light emission in the third region are different from each other;

in the fourth subframe period, performing light emission at the same time in the first region and in the third region; performing non-light emission at the same time in the second region and in the fourth region, wherein a color of light emission in the first region and a color of light emission in the third region are each white and in the fifth subframe period, performing light emission at the same time in the second region and in the fourth region; performing non-light emission at the same time in the first region and in the third region, wherein a color of light emission in the second region and a color of light emission in the fourth region are each white, wherein light emission or non-light emission is performed in the first region and in the third region, which are separated from each other with the second region interposed therebetween; and light emission or non-light emission is performed in the second region and in the fourth region, which are separated from each other with the third region interposed therebetween, wherein a color of light emission in the first region in the first subframe period is the same as a color of light emission in the second region in the second subframe period, and wherein the color of light emission in the second region in the second subframe period is different from a color of light emission in the third region in the third subframe period.

10. The method for driving a display device according to claim 9, wherein color display is performed by using red, green, and blue.

11. The method for driving a display device according to claim 9, wherein the fourth subframe period is provided as an initial period of the one-frame period and the fifth subframe period is provided successively to the fourth subframe period, or wherein the fifth subframe period is provided as a last period of the one-frame period and the fifth subframe period is provided successively to the fourth subframe period.

12. The method for driving a display device according to claim 9, wherein light emission of the white is obtained by performing at the same time light emission of light sources whose colors are complementary to each other or by performing at the same time light emission of red light source, green light source, and blue light source.

13. The method for driving a display device according to claim 9, wherein the plurality of subframe periods includes a subframe period in which a whole of the light source region emits no light.

14. The method for driving a display device according to claim 9, wherein the display device is a liquid crystal display device.

15. A method for driving a display device comprising a backlight portion having a light source region which is divided into a first region, a second region, a third region, a fourth region, a fifth region, and a sixth region; and a pixel portion which is divided into a first pixel region, a second pixel region, a third pixel region, a fourth pixel region, a fifth pixel region, and a sixth pixel region corresponding to the first region, the second region, the third region, the fourth region, the fifth region, and the sixth region, respectively, wherein the display device is displayed by a field sequential method, and wherein one-frame period comprises a plurality of subframe periods including a first subframe period, a second subframe period, a third subframe period consecutively in this order, and further including a fourth subframe period, and fifth subframe period, comprising the steps of:

in the first subframe period, performing light emission at the same time in the first region, in the third region, and in the fifth region; performing non-light emission at the same time in the second region, in the fourth region, and in the sixth region, wherein a color of light emission in the first region, a color of light emission in the third region, and a color of light emission in the fifth region are different from one another;

in the second subframe period, performing light emission at the same time in the second region, in the fourth region, and in the sixth region; performing non-light emission at the same time in the first region, in the third region, and in the fifth region, wherein a color of light emission in the second region, a color of light emission in the fourth region, and a color of light emission in the sixth region are different from one another;

in the third subframe period, performing light emission at the same time in the first region, in the third region, and in the fifth region; performing non-light emission at the same time in the second region, in the fourth region, and in the sixth region, wherein a color of light emission in the first region, a color of light emission in the third region, and a color of light emission in the fifth region are different from one another;

in the fourth subframe period, performing light emission at the same time in the first region, in the third region, and in the fifth region; performing non-light emission at the same time in the second region, in the fourth region, and in the sixth region, wherein a color of light emission in the first region, the third region, and the fifth region are each white; and in the fifth subframe period, performing light emission at the same time in the second region, in the fourth region, and in the sixth region; performing non-light emission at the same time in the first region, in the third region, and in the fifth region, wherein a color of light emission in the second region, a color of light emission in the fourth region, and a color of light emission in the sixth region are each white, wherein light emission or non-light emission is performed in the first region and in the third region, which are separated from each other with the second region interposed therebetween; light emission or non-light emission is performed in the second region and in the fourth region, which are separated from each other with the third region interposed therebetween; light emission or non-light emission is performed in the third region and in the fifth region, which are separated from each other with the fourth region interposed therebetween; and light emission or non-light emission is performed in the fourth region and in the sixth region, which are separated from each other with the fifth region interposed therebetween, wherein a color of light emission in the first region in the first subframe period is the same as a color of light emission in the second region in the second subframe period, wherein the color of light emission in the second region in the second subframe period is different from a color of light emission in the third region in the third subframe period, wherein a color of light emission in the third region in the first subframe period is the same as a color of light emission in the fourth region in the second subframe period, and wherein the color of light emission in the fourth region in the second subframe period is different from a color of light emission in the fifth region in the third subframe period.

16. The method for driving a display device according to claim 15, wherein color display is performed by using red, green, and blue.

17. The method for driving a display device according to claim 15, wherein the fourth subframe period is provided as an initial period of the one-frame period and the fifth subframe period is provided successively to the fourth subframe period, or wherein the fifth subframe period is provided as a last period of the one-frame period and the fifth subframe period is provided successively to the fourth subframe period.

18. The method for driving a display device according to claim 15, wherein light emission of the white is obtained by performing at the same time light emission of light sources whose colors are complementary to each other or by performing at the same time light emission of red light source, green light source, and blue light source.

19. The method for driving a display device according to claim 15, wherein the plurality of subframe periods includes a subframe period in which a whole of the light source region emits no light.

20. The method for driving a display device according to claim 15, wherein the display device is a liquid crystal display device.

21. A method for driving a display device comprising a backlight portion having a light source region including a first region, a second region, and a third region, wherein one-frame period comprises a first subframe period, a second subframe period, and a third subframe period consecutively in this order, comprising the steps of:

in the first subframe period, at the same time, performing light emission in the first region and in the third region, and non-light emission in the second region, wherein a color of light emission in the first region is different from a color of light emission in the third region;

in the second subframe period, at the same time, performing light emission in the second region, and non-light emission in the first region and in the third region; and in the third subframe period, at the same time, performing light emission in the first region and in the third region, and non-light emission in the second region, wherein a color of light emission in the first region is different from a color of light emission in the third region, wherein the first region and the third region are separated from each other with the second region interposed therebetween, wherein a color of light emission in the first region in the first subframe period is the same as a color of light emission in the second region in the second subframe period, and wherein the color of light emission in the second region in the second subframe period is different from a color of light emission in the third region in the third subframe period.

22. The method for driving a display device according to claim 21, wherein color display is performed by using red, green, and blue.

23. The method for driving a display device according to claim 21, wherein the one-frame period includes a subframe period in which a whole of the light source region emits no light.

24. The method for driving a display device according to claim 21, wherein the display device is a liquid crystal display device.

* * * * *